US009814324B2

(12) United States Patent
Scarleski

(10) Patent No.: US 9,814,324 B2
(45) Date of Patent: Nov. 14, 2017

(54) PASSIVE MATTRESS ENCASEMENT

(71) Applicant: Levitation Sciences LLC, Chicago, IL (US)

(72) Inventor: William John Scarleski, Chicago, IL (US)

(73) Assignee: LEVITATION SCIENCES LLC, Chicago, IL (US)

( * ) Notice: Subject to any disclaimer, the term of this patent is extended or adjusted under 35 U.S.C. 154(b) by 359 days.

(21) Appl. No.: 14/046,113

(22) Filed: Oct. 4, 2013

(65) Prior Publication Data

US 2015/0096121 A1 Apr. 9, 2015

(51) Int. Cl.

| | |
|---|---|
| ***A47C 31/10*** | (2006.01) |
| ***A47G 9/02*** | (2006.01) |
| ***A47C 21/02*** | (2006.01) |

(52) U.S. Cl.

CPC ..... *A47C 31/105* (2013.01); *A47C 21/028* (2013.01); *A47G 9/0238* (2013.01); *Y10T 29/49817* (2015.01)

(58) Field of Classification Search

CPC ..... A47G 9/00; A47G 9/02; A47G 9/0238; A47G 9/0246; A47C 31/105

USPC ... 5/482, 484, 496–500, 502, 737, 738, 925, 5/926

See application file for complete search history.

(56) References Cited

U.S. PATENT DOCUMENTS 2,400,731 A 5/1946 Armstrong
2,849,729 A 9/1958 Goodey, Jr. et al.
3,027,573 A * 4/1962 Bell, Jr. ..... A47C 27/22 5/500
3,261,177 A 7/1966 Amann et al.
3,266,066 A * 8/1966 Bereday ..... A47C 31/023 297/452.1
3,287,749 A * 11/1966 Marsico ..... A47C 27/05 5/716
3,416,626 A 12/1968 Nagamatsu
(Continued)

FOREIGN PATENT DOCUMENTS

EP 1 106 115 6/2001
EP 1 645 258 4/2006
(Continued)

OTHER PUBLICATIONS

U.S. Appl. No. 13/838,408, William Scarleski.
(Continued)

*Primary Examiner* — Robert G Santos
(74) *Attorney, Agent, or Firm* — John S. Paniaguas; Clark Hill PLC

(57) ABSTRACT

A passive mattress encasement is formed to encapsulate a mattress and includes a top panel, a bottom panel and multiple side panels. One or more of the side panels are zippered together. The un-zippered side panels fixedly connect the top panel to the bottom panel. The underside of the top panel and optionally the inside of the side panels may be coated with a waterproof coating to form a waterproof membrane. The encasement is configured to facilitate rotation of the mattress. Optional straps may be provided, fixedly attached to the encasement. The straps allow the encasement to be snugged against the mattress to enable the encasement to be used with a relatively wide range of mattress sizes and still provide a snug fit.

6 Claims, 25 Drawing Sheets

(56) References Cited

U.S. PATENT DOCUMENTS 3,581,322 A * 6/1971 Marsico ..... A47C 27/05 5/699
RE27,336 E * 4/1972 Bereday ..... A47C 31/026 297/452.6
3,667,073 A 6/1972 Renfroe
3,950,800 A * 4/1976 Garshfield ..... A47C 27/04 5/721
4,046,317 A 9/1977 Hein, Jr.
4,095,299 A 6/1978 Schwiso
4,155,421 A 5/1979 Johnson et al.
4,164,797 A 8/1979 Golembeck
4,319,781 A * 3/1982 Tsuge ..... B62J 1/18 150/167
4,437,704 A * 3/1984 Hovsepians ..... A47C 4/02 297/440.14
4,517,690 A 5/1985 Wegener
4,706,313 A * 11/1987 Murphy ..... A47C 27/148 5/722
4,944,053 A 7/1990 Smith
5,022,110 A 6/1991 Stroh
5,065,485 A * 11/1991 Zocco ..... A47C 31/105 29/525.03
5,088,952 A 2/1992 Goldblatt
5,168,589 A 12/1992 Stroh et al.
5,257,430 A 11/1993 Yamaguchi
5,313,679 A 5/1994 Yamaguchi
5,318,481 A 6/1994 St-Germain
5,360,363 A 11/1994 Levin
5,414,882 A 5/1995 Goodale
5,429,852 A * 7/1995 Quinn ..... A47C 7/18 297/452.26
5,473,783 A 12/1995 Allen
5,488,746 A 2/1996 Hudson
5,628,077 A 5/1997 Brigani
5,631,074 A 5/1997 Herlihy
5,632,054 A 5/1997 Hutton et al.
5,815,865 A 10/1998 Washburn et al.
5,860,174 A 1/1999 Failor
6,073,291 A 6/2000 Davis
6,274,520 B1 8/2001 Cordell
6,381,778 B1 * 5/2002 Peterson ..... A47C 27/005 5/484
6,457,196 B1 10/2002 Dykes et al.
6,684,434 B2 2/2004 Ellis et al.
6,728,978 B1 5/2004 Nordin
6,795,989 B2 9/2004 Fairchild et al.
6,886,203 B2 5/2005 Drakos
6,966,083 B1 11/2005 Cheng
7,051,388 B1 5/2006 Taddeo
7,120,952 B1 10/2006 Bass et al.
7,155,763 B2 1/2007 North
7,240,384 B2 * 7/2007 DuDonis ..... A47C 20/027 5/633
7,481,290 B2 1/2009 Pendzich
7,581,270 B1 9/2009 Levesque
7,617,556 B2 11/2009 Rensink
7,644,671 B2 1/2010 Smith
7,725,963 B2 6/2010 Johnson
7,730,567 B2 6/2010 Jaeger
7,735,164 B1 6/2010 Patrick
7,849,533 B1 12/2010 Receveur et al.
7,917,979 B2 4/2011 Amsler, Jr. et al.
7,975,330 B2 7/2011 Receveur et al.
8,006,331 B1 8/2011 Scarleski
8,087,111 B2 1/2012 Paris
8,122,541 B1 2/2012 Geogatos
8,156,588 B2 4/2012 Svoboda
8,201,292 B2 6/2012 Dionne et al.
8,246,706 B2 8/2012 Scarleski
8,510,880 B2 8/2013 Scarleski
8,549,681 B2 10/2013 Scarleski
8,863,326 B2 * 10/2014 Scarleski ..... A47C 21/00 5/488
8,959,675 B2 * 2/2015 Scarleski ..... A47C 21/00 5/482
9,021,630 B2 * 5/2015 Scarleski ..... A47C 21/00 5/488
9,596,946 B2 * 3/2017 Scarleski ..... A47C 31/105
2003/0029062 A1 2/2003 Esterman
2003/0079292 A1 5/2003 Ellis et al.
2003/0106157 A1 * 6/2003 Rugset ..... A47C 31/10 5/738
2004/0133978 A1 7/2004 Fairchild
2004/0172763 A1 * 9/2004 Sachs ..... A47C 7/021 5/656
2004/0226089 A1 11/2004 Miranda
2005/0005358 A1 * 1/2005 DuDonis ..... A47C 20/027 5/632
2005/0172412 A1 8/2005 Pearson
2005/0229318 A1 10/2005 Peng
2006/0010608 A1 1/2006 DeFranks et al.
2007/0022533 A1 2/2007 Borino
2007/0251017 A1 11/2007 Speer et al.
2008/0028522 A1 2/2008 Atwood
2008/0040858 A1 2/2008 Sakaldasis
2008/0096001 A1 4/2008 Emden et al.
2008/0141463 A1 6/2008 Dionne
2008/0264983 A1 10/2008 Kastan
2008/0301876 A1 12/2008 Kenalty et al.
2009/0004452 A1 1/2009 Assink
2009/0056030 A1 3/2009 Bolden
2009/0083909 A1 4/2009 Amsler
2009/0106893 A1 4/2009 Blevins
2010/0258344 A1 10/2010 Creasy
2011/0010856 A1 1/2011 Bell
2011/0041247 A1 2/2011 Moon
2011/0099713 A1 5/2011 Gonser
2011/0265268 A1 11/2011 Scarleski
2011/0265269 A1 11/2011 Scarleski
2011/0278888 A1 11/2011 Miles
2012/0117778 A1 5/2012 Scarleski
2012/0137433 A1 6/2012 Snell et al.
2012/0151680 A1 6/2012 Scarleski
2012/0167302 A1 7/2012 Malouf
2012/0167307 A1 7/2012 Michael
2012/0174323 A1 7/2012 Platek
2012/0192356 A1 8/2012 Svoboda
2012/0246834 A1 10/2012 Scarleski
2012/0255120 A1 10/2012 Poston et al.
2012/0260426 A1 10/2012 Dobin
2012/0260432 A1 10/2012 Scarleski
2013/0019411 A1 1/2013 Scarleski
2013/0174349 A1 7/2013 Amaral et al.
2013/0212809 A1 8/2013 Scarleski
2013/0232698 A1 9/2013 Ward
2014/0026318 A1 1/2014 Bethel et al.
2014/0075679 A1 * 3/2014 Scarleski ..... A47C 21/00 5/737
2015/0000043 A1 * 1/2015 Scarleski ..... A47C 21/00 5/658
2015/0096120 A1 * 4/2015 Scarleski ..... A47C 31/105 5/484
2015/0096121 A1 * 4/2015 Scarleski ..... A47C 31/105 5/484
2015/0128355 A1 * 5/2015 Scarleski ..... A47C 21/00 5/737
2015/0128356 A1 * 5/2015 Scarleski ..... A47C 21/00 5/737
2015/0208816 A1 * 7/2015 Scarleski ..... A47C 21/00 5/488
2015/0305512 A1 * 10/2015 Scarleski ..... A47C 21/00 5/510
2015/0359346 A1 * 12/2015 Scarleski ..... A47C 21/026 5/658
2015/0359348 A1 * 12/2015 Scarleski ..... A47C 21/028 5/659
2015/0359352 A1 * 12/2015 Scarleski ..... A47C 31/105 29/428
2015/0366362 A1 * 12/2015 Scarleski ..... A47C 21/026 5/658
2017/0007036 A1 * 1/2017 Scarleski ..... A47C 31/105

(56) References Cited

U.S. PATENT DOCUMENTS

| | | | | |
|---|---|---|---|---|
| 2017/0105542 | A1* | 4/2017 | Scarleski | A47C 31/105 |
| 2017/0105543 | A1* | 4/2017 | Scarleski | A47C 31/105 |
| 2017/0135493 | A1* | 5/2017 | Scarleski | A47C 21/00 |

FOREIGN PATENT DOCUMENTS

| | | |
|---|---|---|
| WO | PCT/US2011/34537 | 5/2011 |
| WO | PCT/US2011/34551 | 8/2011 |
| WO | PCT/US13/47883 | 10/2013 |

OTHER PUBLICATIONS

U.S. Appl. No. 14/015,223, William Scarleski.
U.S. Appl. No. 14/046,047, William Scarleski.
http:/questoutfitters.com /coated.html—May 6, 2010.
http:/www.rockywoods.com—May 6, 2010.
http:/www.rockywoods.com/Fabrics-Hardware-Patterns-Kits/Medium-Weight-Nylon-Fabrics/Heat-Sealable-70-Denier-Nylon-Taffeta—May 6, 2010.
http:/www2.dupont.com/Products_and_Services/en VN/nwyn.html—May 6, 2010.
http:/www.seattlefabrics.com/nylons.html—May 6, 2010.
http:/www.mattressdirectonline.com—May 5, 2010.
http:/www.nextag.com/INVACARE-MicroAir-Lateral-Rotation-628052627/prices-html Sep. 14, 2009.
http:/uncyclopedia.wikia.com/wiki/Mattress_racing—Sep. 14, 2009.
http:/www.primeconveyor.com/productDetail.asp_Q_catID_E_92_A_subCatID_E_129_. . . Sep. 14, 2009.

* cited by examiner

PASSIVE MATTRESS ENCASEMENT

BACKGROUND OF THE INVENTION

1. Field of the Invention

The present invention relates to a passive mattress encasement which can be relatively easily installed over a mattress supported by a box spring or fixed or adjustable platform (hereinafter "foundation") which also facilitates rotation of the mattress even in applications in which a bed skirt is installed over the foundation and can accommodate a relatively wide range of mattress sizes.

2. Description of the Prior Art

Mattress encasements are used as a prophylactic cover over the entire mattress to protect the mattress from various situations, such as parasites and stains, for example, pet stains. Such encasements are also available for box springs. As used herein, the term encasement refers to mattress encasements and box spring encasements individually and collectively. Examples of such encasements are disclosed in US Patent Application Publication Nos.: US 2012/0260426; US 2012/0255120; 2012/0192356; 2012/0167302; and 2011/00100856 as well as U.S. Pat. Nos. 8,087,111 and 8,156,588, all hereinafter incorporated by reference.

Some known encasements are made from a vinyl material. There are several problems with such vinyl encasements. One such problem is that they are uncomfortable. Another problem relates to cleaning them after being in contact with blood, urine or other matter. Such vinyl encasements cannot be laundered. In order to solve this problem, encasements made from launderable materials have been developed. For example, U.S. Pat. No. 8,087,111 discloses an encasement formed from two layers; an inner layer and an outer layer. The outer layer is formed from cotton or other common encasement material or a material commonly used for mattress protectors, as well as bedding fabric, such as polyester or a polyester-cotton blend. The inner layer is formed as a waterproof membrane, for example, by way of a polyurethane or other suitable waterproof coating.

Because of the need for laundering, known encasements are formed with a zipper along three sides forming a pocket on one end to enable removal for laundering. In order to launder the encasement, the mattress is normally flipped upside down so that the mattress top is in contact with the box spring and the mattress bottom or encasement bottom is facing upwardly. Next, the mattress is slid off one end to enable the pocket to be slipped over one end of the mattress. The encasement is then slipped over the rest of the mattress bottom. The mattress is again flipped over so that the mattress bottom is resting on the foundation and the comfort top is facing upwardly. The top layer of the encasement with the waterproof membrane is then zipped to the bottom layer to complete the installation. In order to remove an encasement, the zipper is unzipped along all three sides and the mattress is lifted to remove the encasement.

Mattresses are relatively heavy items. The weight of a mattress varies as a function of the coil core size, the gauge of the coil and the type of foam material used. An average king size mattress weighs between 85 and 115 pounds. High end king size mattresses with latex or memory foam can weigh as much as 300 pounds (http:/www.mattressdirectonline.com). As such, lifting the mattress to remove the encasement and flipping it over twice to install a clean encasement can be an extremely difficult task, especially considering hotels and motels where multiple encasements may be changed in a single day.

Another problem relates to rotation of a mattress that is encased in an encasement. For one thing, the mattress handles are covered by the encasement making an encased mattress difficult to rotate. The problem is especially acute if there is a bed skirt on the foundation. In that case, rotation of the mattress would move the bed skirt out of position, essentially requiring the mattress to be rotated by lifting the mattress and rotating the mattress while lifted.

Another problem relates to the fact that there is no standard size for a mattress. Commonly available mattresses are normally 4" to 18" in depth. Some available mattresses are 20" in depth or more. Although the length and width measurements of various mattresses are fairly standard, there are known differences in the lengths of the perimeters of the various mattresses. Although different encasement sizes are manufactured to accommodate the various mattress depths, known encasements do not address the differences in perimeter lengths. As such, the encasements, depending on the mattress size, do not always provide a snug fit relative to the mattress, which is highly undesirable from a housekeeping standpoint.

Thus, there is a need for an encasement that can easily be installed or removed for changing or laundering and facilitates rotation of the mattress to even out body impressions, even in applications which include a bed skirt and can accommodate a range of mattress depths.

SUMMARY OF THE INVENTION

Briefly, the present invention relates to an active encasement, which can be relatively easily installed or removed over a mattress supported by a foundation. The encasement is formed to encapsulate a mattress and includes a top panel, a bottom panel and four side panels. One or more of the four side panels are zippered together. In an embodiment with one, two, or three zippered side panels, the unzipped side panels may be configured to fixedly connect the top panel to the bottom panel. The top and bottom panels as well as the side panels may be made from a conventional or non-conventional encasement material or a material commonly used for mattress protectors, as well as conventional bedding material and/or waterproof and/or spill proof and/or moisture proof and/or anti-bacterial and/or anti-allergen and/or anti-mite and/or bed bug proof material, such as TPU polyurethane coated terry cotton, polyester knit, vinyl, bamboo fabric, or silver infused or coated type material (hereinafter "materials"), or any combination of the above. The underside of the top panel and optionally the inside of the side panels may be coated or embossed with a waterproof layer or coating, such as polyurethane, to form a waterproof membrane.

In accordance with an important aspect of one embodiment of the invention, an interior surface of the bottom panel is formed with a slick surface while the exterior surface of the bottom panel faces outwardly and is adapted to be in contact with the foundation or bed skirt. In this embodiment, the exterior surface of the bottom panel of the encasement is formed as a non-slick surface. The non-slick surface provides a frictional relationship between the exterior surface of the bottom panel of the encasement and the foundation or bed skirt while the encasement is being installed, removed, or rotated, over a mattress. The slick interior surface of the bottom panel allows a mattress to be rotated once the bottom panel is juxtaposed between the mattress and the foundation in an application in which the encasement is unzipped and the top panel is disposed on the floor adjacent one end of the mattress. The present invention also facilitates installation and removal of the encasement over a mattress. Optional straps may be provided, rigidly affixed to the encasement. The straps allow the encasement to be snugged against the mattress to enable the encasement to be used with a relatively wide range of mattress depths and perimeter lengths and still provide a snug fit.

DESCRIPTION OF THE DRAWING

These and other advantages of the present invention will be readily understood with reference to the following specification and attached drawing wherein.

DETAILED DESCRIPTION

The present invention relates to a passive encasement which can be relatively easily installed or removed over a mattress supported by a foundation. The encasement is formed to encapsulate a mattress and includes a top panel, a bottom panel and four side panels and a conventional, or alternatively, a non-conventional, zipper and zipper enclosure, as well as zippers and zipper enclosures typically used for encasements (hereinafter "zipper"). As used herein, a side panel is understood to mean those portions or the encasement that contact the side panels of the mattress when the encasement is installed. One or more of the side panels are zippered together. In embodiments in which one, two, or three panels are zippered together, the un-zippered side panel(s) may be configured to fixedly connect the top panel to the bottom panel. The top and bottom panels, as well as the side panels, may be made from a conventional encasement material or a material commonly used for mattress protectors, as well as conventional bedding material, as described above. The underside of the top panel and optionally the inside of the side panels may be coated with a waterproof coating, such as polyurethane, to form a waterproof membrane.

In alternative embodiments, the bottom panel may be formed to attach directly to the side panels of the encasement. In this embodiment, the top panel and side panels may be integrally formed and zipper directly to the bottom panel.

In accordance with an important aspect of the invention, the bottom panel is formed with a slick interior surface and a non-slick exterior surface. The exterior non-slick surface allows a mattress to be rotated without affecting the position of an underlying bed skirt in applications in which a bed skirt is covering the foundation while the slick interior surface facilitates rotation of the mattress. The present invention also facilitates installation and removal of the encasement over a mattress or a foundation, such as a box spring. Optional straps may be provided, rigidly affixed to the encasement. The straps allow the encasement to be snugged against the mattress or foundation to enable the encasement to be used with a relatively wide range of mattress and foundation depths and still provide a snug fit.

Figure 1:
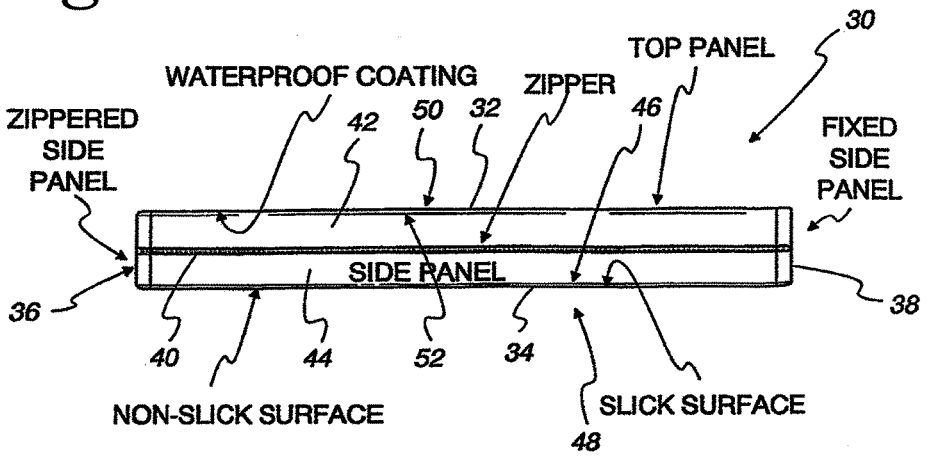
FIG. 1 is a side elevational view of one embodiment of an encasement in accordance with the present invention.
Figure 1A:
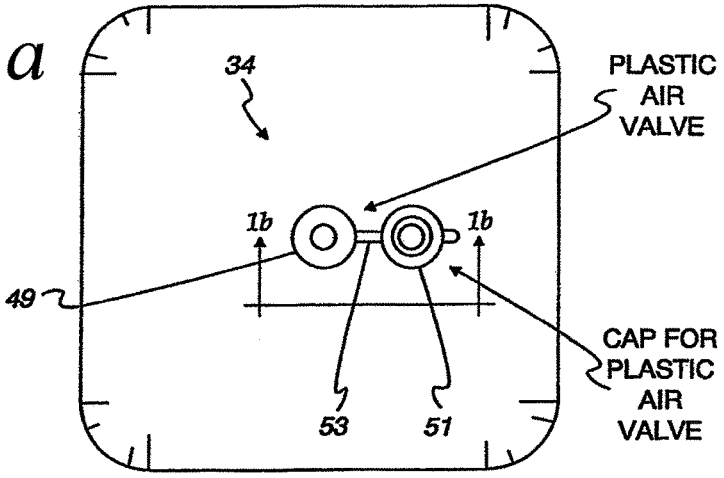
FIG. 1*a* is a bottom view of the encasement shown in FIG. 1 illustrating an optional air valve with an optional cap integrally formed in a bottom panel of the encasement.
Figure 1B:
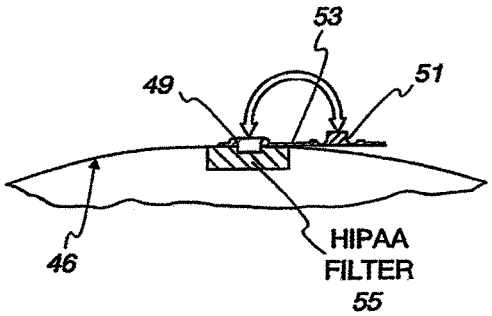
FIG. 1*b* is a section view along line 1*b*-1*b* of FIG. 1*a* illustrating an optional filter, such as a HEPA filter attached to an interior or exterior surface of the encasement for filtering air into and out of the encasement.
Figure 2:
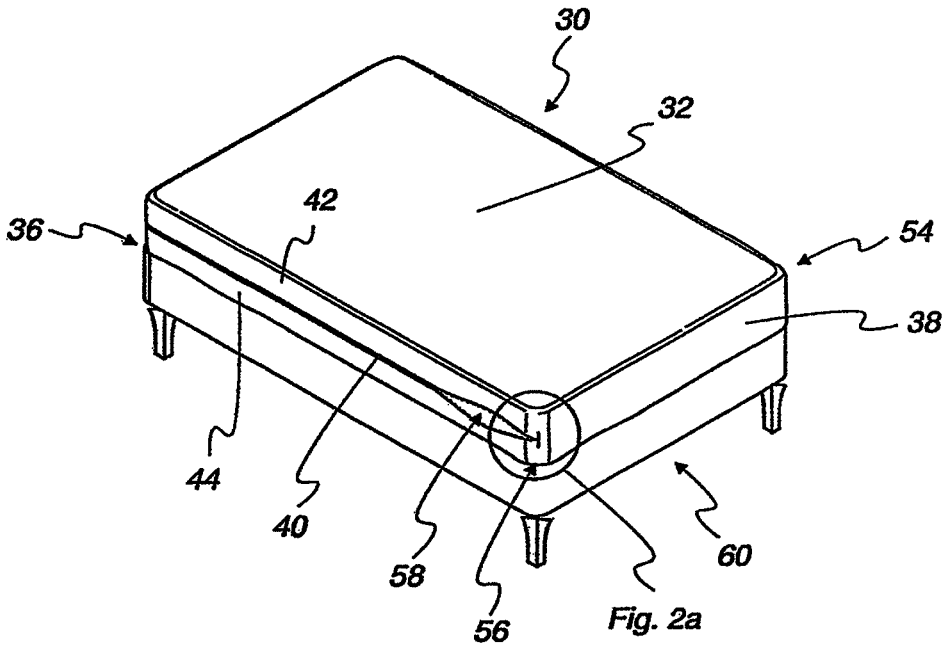
FIG. 2 is an isometric view of mattress supported by a foundation in which the mattress is covered with an encasement, shown with the encasement partially unzipped.
Figure 2A:
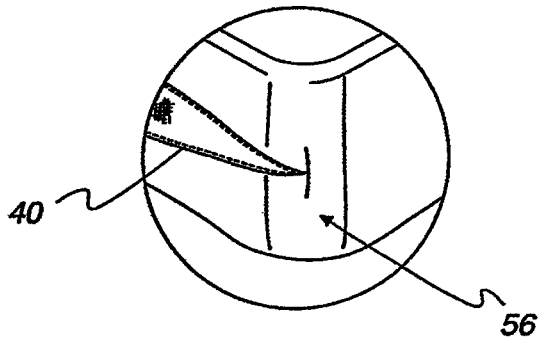
FIG. 2*a* is an enlarged partial exploded view of one corner of the mattress illustrated in FIG. 2.
Figure 24:
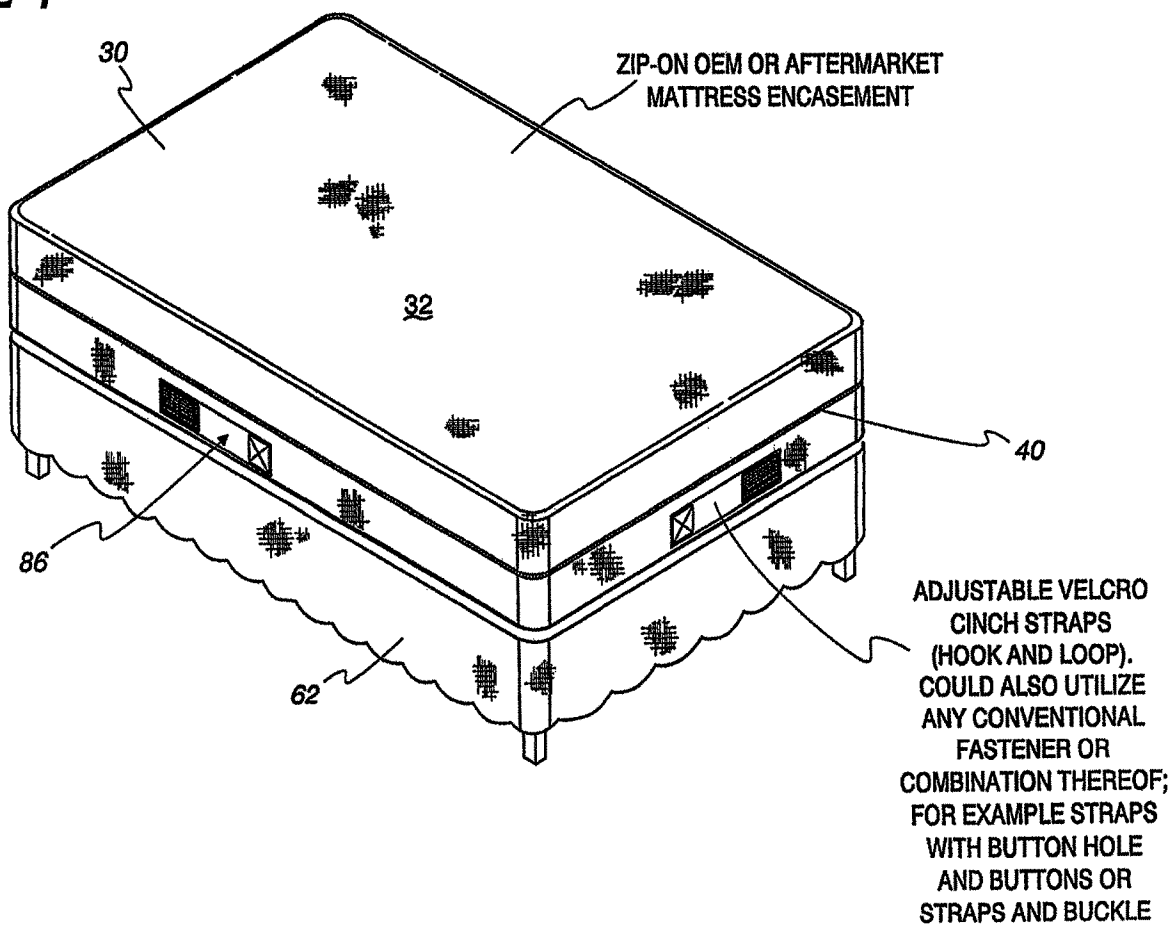
FIG. 24 is an isometric view of a bed shown with an encasement encasing a mattress illustrating optional horizontal straps to snug the encasement relative to the mattress.

Four embodiments of the encasement are illustrated. FIGS. 1, 2, and 2*a* illustrate one embodiment of the encasement. FIGS. 1*a* and 1*b* illustrate an optional second embodiment. FIGS. 18*a*-23*b* illustrate a third embodiment. FIG. 24 illustrates a fourth embodiment. The features of all of the embodiments may be combined to form an additional embodiment of the encasement. All of the embodiments are suitable for use on a mattress or box spring.

Figure 15:
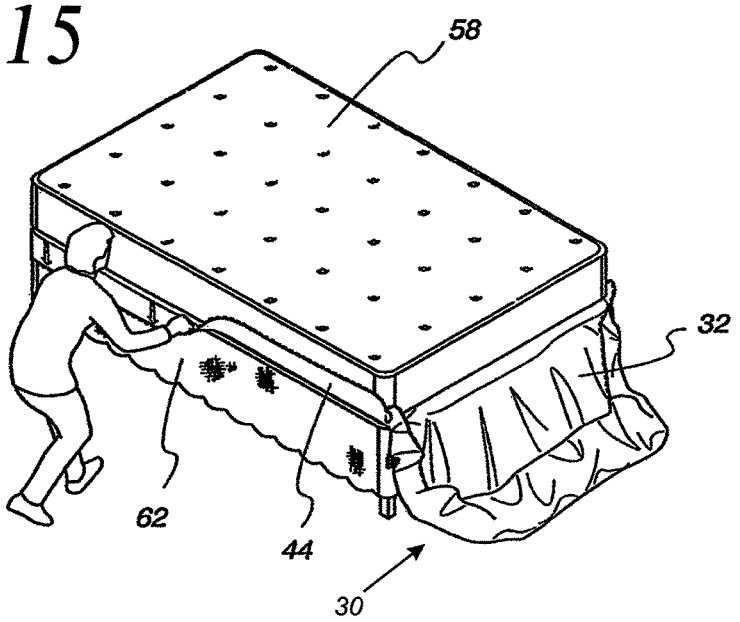
FIG. 15 illustrates the lower side panel portions of the encasement being folded down over the bed skirt.
Figure 16:
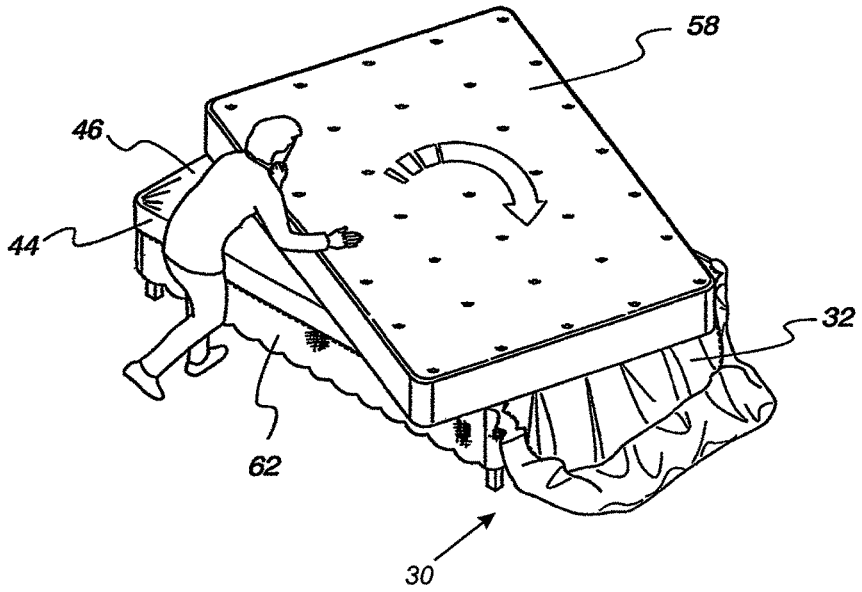
FIG. 16 illustrates rotation of the mattress while the encasement and bed skirt remains in place.
Figure 17:
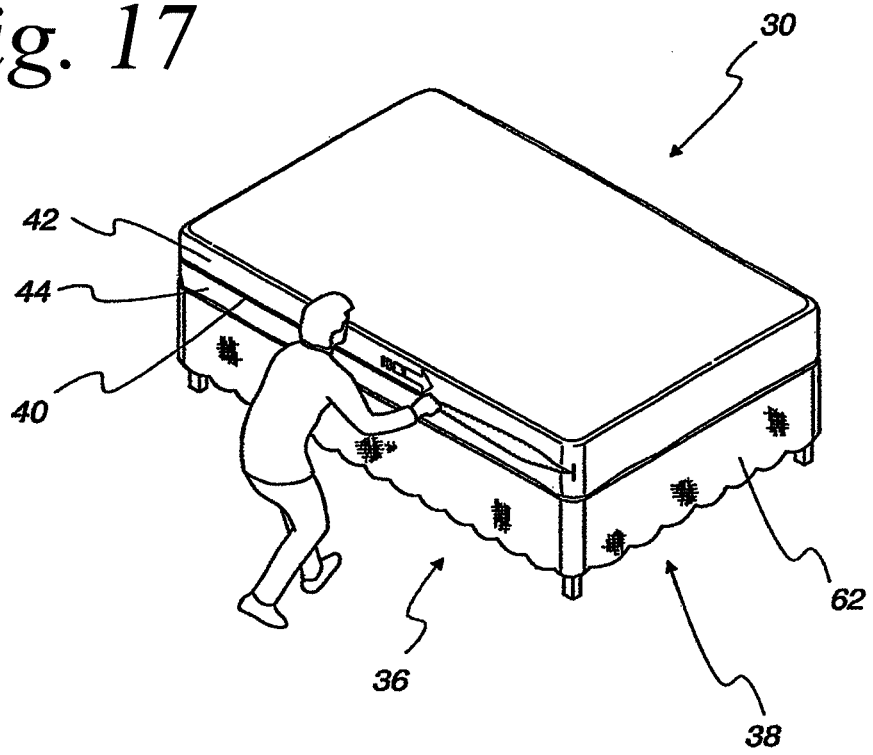
FIG. 17 illustrates the upper and lower side panel portions being zipped together after the top panel of the encasement has been re-positioned over the top of the mattress, as shown in FIG. 11.
Figure 17A:
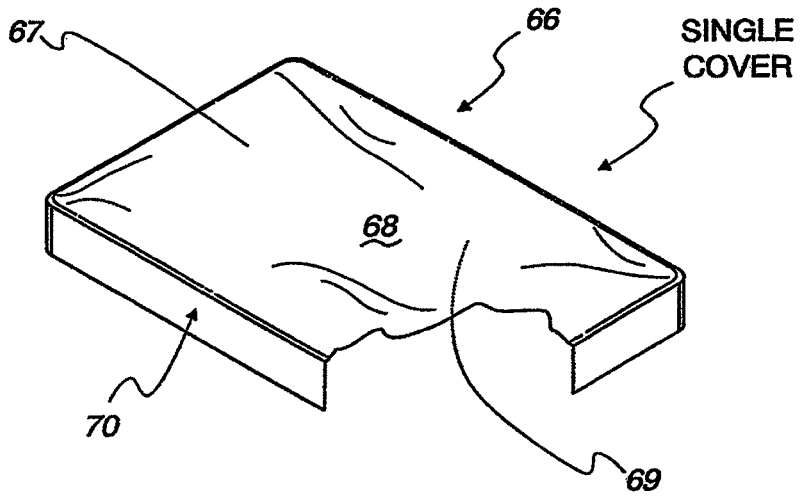
FIG. 17*a* is an isomeric drawing of a single cover that may be incorporated with the present invention.

In addition to the physical embodiments discussed above, a novel method for installing the encasement on a mattress is illustrated in FIGS. 5-12 while maintaining a bed skirt in place. FIGS. 13-17 illustrate a novel method for rotating a mattress with an encasement. FIG. 17*a* illustrates a modular component for the encasement which provides additional mattress management capabilities, as discussed below.

Referring first to FIGS. 1, 2 and 2*a*, a passive encasement in accordance with the present invention is shown and identified with the reference numeral 30. As shown, the encasement includes a top panel 32, a bottom panel 34 and four side panels. In this embodiment, three of the side panels 36 include a zipper 40 or other conventional attachment means which define an upper side panel portion 42 and a lower side panel portion 44. In embodiments in which one or more of the four side panels are zippered together, the un-zippered side panel 38 may be formed as a single piece that connects the upper panel 32 to the lower panel 34 on one side.

Figures 1C, 1D:
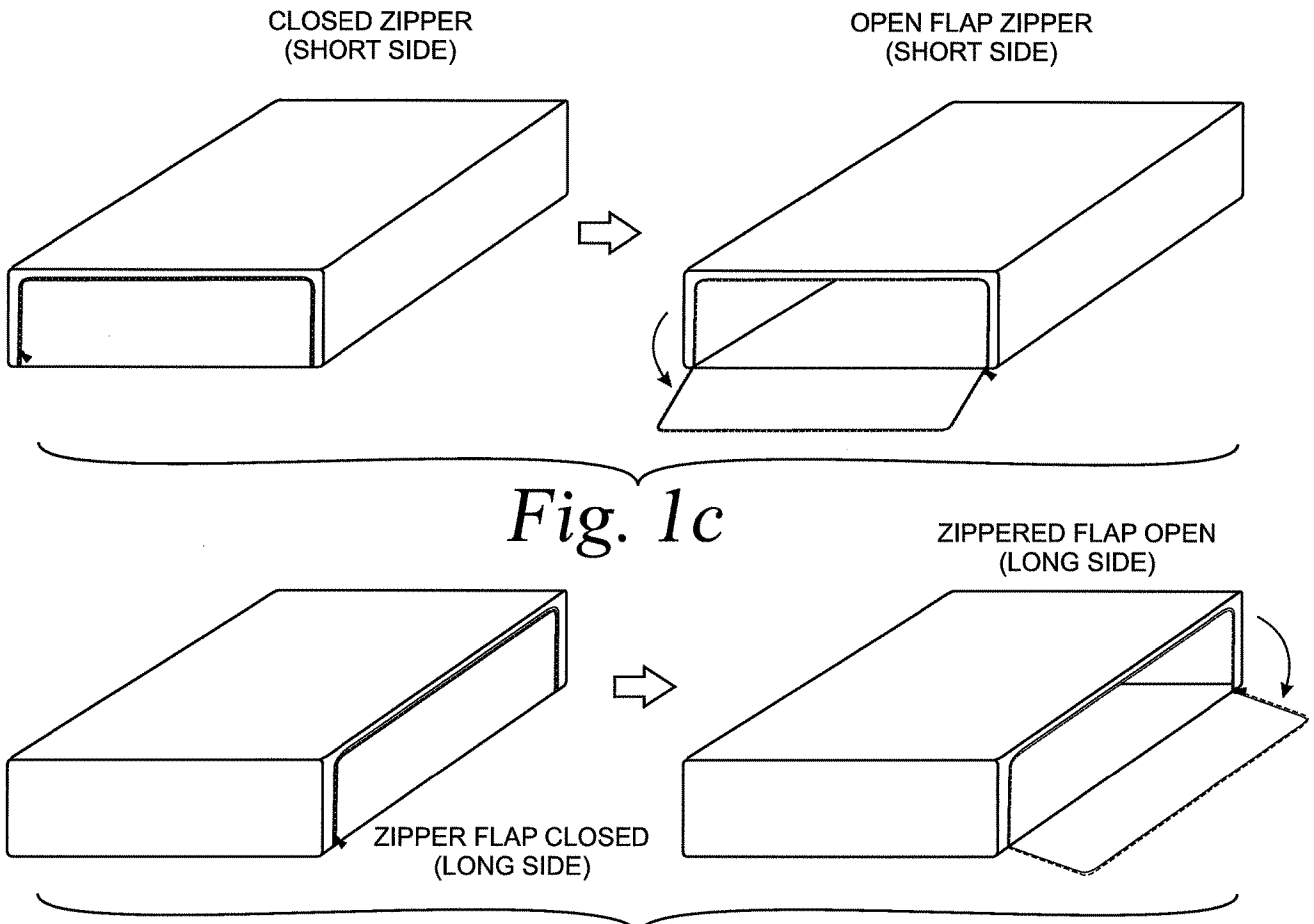
FIG. 1*c* is an alternate embodiment of the invention in which a zipper is disposed in a short side panel on one end along three (3) edges of the side panel, illustrating the encasement zipped and unzipped.
FIG. 1*d* is similar to FIG. 1*c* but illustrating a zipper on a long side panel.

Alternatively, only one side panel of the encasement may be zippered, as illustrated in FIGS. 1*c* and 1*d*. Referring first to FIG. 1*c*, an embodiment is illustrated in which a short side panel of the encasement is zippered. FIG. 1*d* illustrates an embodiment in which a long side panel is zippered.

FIGS. 1*a* and 1*b* illustrate a second embodiment with an optional feature of the invention. Specifically an optional air valve, such as a conventional plastic air valve 49 with an optional a cap 51 attached thereto with a strap 53 may be integrated into the encasement 30. Specifically, the air valve may be attached anywhere on the encasement 30, for example, the top panel 32 or bottom panel 34 or one of the side panels 36 or 38. The valve 49 facilitates packing the encasement 30 for travel for use on hotel and motel mattresses. The valve 49 allows air to be removed to minimize the space the encasement will take in a suitcase or travel bag. The air may be removed manually or mechanically, for example, by way of a vacuum cleaner.

After the encasement 30 is used on a hotel or motel mattress, it is preferable to zip up the encasement 30, remove the air, as discussed above, and transport the encasement in a zipped up condition until the encasement can be laundered. This is done to prevent mites, bed bugs, allergens, certain microbes, and the like from the hotel or motel mattress from being released in a suitcase or travel bag. A HEPA filter 55 (FIG. 1*b*) may be fixedly attached to an interior or exterior surface of the encasement, for example, the surface 46, to cover the airway of the valve 49 to prevent bed bugs or dust mites or bacteria or allergens picked up from the hotel or motel mattress from escaping through the air valve 49. Alternatively, the air valve can be omitted and a small aperture formed anywhere on the encasement covered with a HEPA filter may be used.

Referring back to FIGS. 1 and 2, the top panel 32 and bottom panel 34 are generally rectangular in shape and are configured to fit the length and width of standard bed sizes. US standard mattress sizes are provided below in Table 1. It is to be noted that the principles of the invention are also applicable to non-US mattress sizes, as well as non-standard sizes. As will be discussed below, the principles of the invention also apply to mattresses having different depths, even so-called "deep pocket" mattresses.

TABLE 1

US Standard Mattress Sizes

| Common Term | Length × width dimension in inches | Length × width dimension in centimeters |
|---|---|---|
| Twin | 39 × 75 | 99 × 190 |
| X-Long Twin | 39 × 80 | 99 × 203 |
| Full | 54 × 75 | 137 × 190 |
| Queen | 60 × 80 | 153 × 203 |
| King | 76 × 80 | 198 × 203 |
| California King | 72 × 84 | 182 × 213 |

The encasement 30 in accordance with the present invention provides standard protection for a mattress from spills and/or allergens and/or parasites and/or stains but also provides additional features which relate to the management of the mattress, as discussed below. These features are provided by the novel construction of the encasement 30.

More particularly, the bottom panel 34 is configured to facilitate various mattress management features without compromising the ability of the encasement 30 to provide protection from spills and/or allergens and/or parasites and/or stains. Specifically, the bottom panel 34 includes an interior surface 46 and an exterior surface 48. The interior surface 46 is formed with a slick surface while the exterior surface 48 is formed with a non-slick surface.

Various materials described below can be used for the bottom panel 34 having a slick interior surface 46 and a non-slick exterior surface 48. All of the materials used for the encasement 30 may be launderable. As used herein, the terms "slick" and "non-slick" refer to their respective relative co-efficient of friction. In other words, the present invention contemplates materials in which the "slick" surface has a relatively lower co-efficient of friction than the "non-slick" surface. Exemplary materials are provided below. As used herein, the materials and or coatings may be formed as a single layer or multiple layers.

The non-slick exterior surface 48 can be created on one side of a slick material by way of a coating or sewing or fusing a non-slick backing to one side of the non-slick material. Various conventionally available materials are suitable for the bottom panel 34 having a slick interior surface 46 on one side and a non-slick exterior surface 48 on an opposing side. For example, 70 Denier Heat Sealable (backside) 100% Nylon Rip Stop material is suitable for use for the bottom panel 34. Other materials with similar coefficients of friction with a coating on one side, for example, urethane, silicone, or coated or bonded or sewn or fused thermal plastic or heat sealable coatings are also suitable.

Such nylon or polyester rip stop material is known to come in widths of 32-104" inches wide and weigh about 0.9 to 4.4 ounces per square yard. Such material can easily be pieced together to accommodate various mattress widths if necessary. Nylon or polyester rip stop material suitable for use with the present invention is available from various sources, such as, Quest Outfitters of Sarasota, Fla. (http:/questoutfitters.com). Nylon taffeta material is also suitable and is described in detail at http:/questouffitters.com/coated.html#HEAT SEALABLE, hereby incorporated by reference. Suitable nylon or polyester taffeta material is also available from Rockywoods in Loveland, Colo. (http:/www.rockywoods.com). Their nylon taffeta material is described in detail at http:/www.rockywoods.com/Fabrics-Hardware-Patterns-Kits/Medium-Weight-Nylon-Fabrics/Heat-Sealable-70-Denier-NvIon-Taffeta, hereby incorporated by reference.

Non-woven materials may also be used for the bottom panel 34 having a slick interior surface 46 and a non-slick exterior surface 48. For example, Tyvek® polyethylene non-woven fabric, as manufactured by the DuPont Corporation and described in detail at http:/www2.dupont.com/Products and Services/en VN/nwn.html may be used. Other materials having two slick sides can also be used, such as, silicone impregnated nylon rip stop, for example, as available from Seattle Fabrics, Inc., http:/www.seattlefabrics.com/nylons.html. Other materials can also be used with a coating applied to one side. Moreover, different materials can be used for each cover in an application.

Various other materials with a slick side and a non-slick side are also suitable for the bottom panel 34. For example, the following exemplary materials may be used:

- warp-knit fabric with a polyurethane laminate coating or a silicone coating.
- a non-woven material with a polyurethane laminate coating or a silicone coating.
- Tricot fabric with a polyurethane backing or a silicone coating.
- neoprene fabric with a polyurethane backing or a silicone coating.
- ballistic nylon or polyester fabric with polyurethane backing or a silicone coating.
- polyester knit fabric with a polyurethane backing or a silicone coating.
- cotton/polyester terry fabric with a polyurethane backing or a silicone coating.
- jacquard knit fabric with a polyurethane backing or a silicone coating.
- coral fleece fabric with a polyurethane backing or a silicone coating.
- microfiber/polyester knit with polyurethane backing or a silicone coating.
- a stitch bond fabric with a polyurethane laminate coating or a silicone coating.
- nylon or polyester rip stop with a silicone coating on one side and a polyurethane coating on the other side
- typical plastic sheeting with nylon or polyester rip stop with a silicone coating on one side and a polyurethane coating on the other side
- woven or non-woven fiberglass fabric with a silicone coating on one side and a polyurethane coating on the other side
- a stitch bond fabric, available from Tietex, item no 944164, style no. C243, wherein the fabric is 32% rayon, 22% polyester, 6% twaron and 40% coat.
- calendared nylon or polyester rip stop with a silicone coating on one side and a polyurethane coating on the other side
- calendared nylon or polyester taffeta with a silicone coating on one side and a polyurethane coating on the other side
- calendared suitable fabric with a silicone coating on one side and a polyurethane coating on the other side Materials having a similar co-efficient of friction and porosity characteristics may also be used. All such materials are considered to be within the broad scope of the invention.

The following textile materials may also be used for the various surfaces discussed above. These textile materials can be used uncoated, coated, layered, bonded, laminated, embossed, impregnated, backed, or etched on one or both sides as indicated below to control the co-efficient of friction to create a slick surface or a non-slick surface relative to the co-efficient of friction on the opposite side.

70 DENIER×70 DENIER NYLON RIPSTOP
70 DENIER×70 DENIER POLYESTER RIPSTOP
70 DENIER NYLON & POLYESTER BLEND
70 DENIER NYLON TAFFETA
70 DENIER POLYESTER TAFFETA
30 DENIER POLYESTER OR NYLON RIPSTOP OR TAFFETA
210 DENIER OXFORD NYLON
210 DENIER OXFORM POLYESTER
210 DENIER NYLON & POLYESTER BLEND
NEOPRENE
BALLISTIC NYLON OR POLYESTER OR POLYESTER BLEND
WARP-KNIT FABRIC
POLYVINYL CHLORIDE (PVC)
POLYETHELENE SHEETING

POLYPROPOLENE SHEETING
NON-WOVEN FABRIC
OLEFIN
POLYOLEFIN
POLYETHYLENE (PE, LLDPE, HDPE)
POLYPROPYLENE
STITCH-BOND FABRIC
COTTON BLEND
TERRY MATERIAL
TRICOT
NYLON COATED MATERIAL
POLYESTER COATED MATERIAL
PRESSURE SENSITIVE BACKED MATERIAL
LAMINATED MATERIAL
HIGH DENSITY & MOLECULAR WEIGHT POLYETHELYNE FILM
POLYETHYLENE VINYL ACETATE

The following materials may be coated, laminated, bonded, impregnated, embossed, fused, layered between, or backed onto a side of the textile material(s) to provide a relatively high co-efficient of friction and thus may be used to provide a relatively non-slick surface, relative to the opposite side.

POLYURETHANE
POLYVINYL CHOLRIDE (PVC)
POLYETHYLENE VINYL ACETATE
THERMO PLASTIC
RUBBER
HEAT SEALABLE
WATER REPELENT
ACRYLIC
ADHESIVE
RAISED NUBS or PATTERN
BLENDED COATING OF ANY OF THE ABOVE
UNCOATED or utilizing the inherently low friction coefficient of an uncoated fabric
FOAM coated/laminated/bonded/impregnated/backing
SILICONE coated/laminated/bonded/impregnated/backing
BLENDED POLYMER coated/laminated/bonded/impregnated/backing
NYLON coated/laminated/bonded/impregnated/backing
POLYESTER coating coated/laminated/bonded/impregnated/backing
THEMOPLASTICS ELASTOMER (TPE) coated/laminated/bonded/impregnated/backing The following materials may be coated, laminated, bonded, impregnated, embossed, fused, layered between, or backed onto a side of the textile material(s) to provide a relatively low co-efficient of friction and thus may be used to provide a relatively slick surface, relative to the opposite side.

SILICONE
TEFLON
PETROLEUM BASE
POLYURETHANE
DIRT WEAR RESISTENT
HEAT SEALABLE
BLENDED COATING OF ANY OF THE ABOVE
SLICK FIBER WOVEN INTO FABRIC
UNCOATED with an inherently low friction coefficient
BLENDED POLYMERS
NYLON
POLYESTER
THERMOPLASTIC ELASTOMER
POLYETHYLENE VINYL ACETATE The top panel 32 is formed with an interior surface 52 and an exterior surface 50. The interior surface 52 may be formed with a waterproof coating or membrane, for example, polyurethane or other conventional waterproof coating. The exterior surface 50 may be formed from cotton or other common encasement material or a material commonly used for mattress protectors, as well as conventional bedding or lauderable fabric, such as polyester or a polyester-cotton. The waterproof membrane may be coated on one side of the upper panel 32.

Various other materials can be used which are waterproof and/or spill proof and/or, moisture proof and/or anti-bacterial and/or anti-allergen and/or anti-dust mite and/or bed bug proof. For example, a bamboo knit fabric with a TPU or PU lamination. Bamboo is naturally occurring anti-bacterial material. The TPU or PU lamination provides waterproofing and anti-allergen, anti-dust-mite, and anti-bed bug protection. Other fabrics with a nano-silver finish with a TPU or PU coating. The nano-silver finish is an non-allergic material. These materials can be used alone or in combination with other materials disclosed herein.

Various configurations for the side panels 36 and 38 are contemplated. For example, the side panels 36 and 38 may be formed from the same material as the bottom panel 34 or the top panel 32 or alternatively from other conventional materials, for providing stain and/or allergen and/or parasite protection. The side panel 38 may be integrally formed with either the top panel 32 or the bottom panel 34. The split side panels 36 define upper and lower side panel portions 42 and 44, respectively, and may be formed from the same material as the bottom panel 34 or top panel 32.

The upper and lower side panel portions 42 and 44, respectively, may be permanently attached to the upper panel 32 and lower panel 34, respectively, by permanent conventional and/or non-conventional means, such as by sewing and/or RF welding and/or heat sealing and/or dielectric sealing and/or welding and/or ultrasonic sealing and/or heat sealing and/or bonding and/or utilizing adhesive and/or weaving and/or may be formed as part of the upper and lower panels 32 and 34. Moreover, the upper and lower side panel portions 42 and 44, respectively, may be formed as a continuous strip serving all three side panels 36. The zipper 40 may be attached to the upper portion 42 and the lower portion 44 of the side panels 36 by permanent conventional means, such as, sewing and/or RF welding and/or heat sealing and/or dielectric sealing and/or welding and/or ultrasonic sealing and/or heat sealing and/or bonding and/or utilizing adhesive and/or weaving.

In order to facilitate installation of the encasement on a mattress or foundation, a zipper 40 is provided from corner to corner on each of the zippered side panels 36. The zipper 40 may be a conventional zipper that extends from one corner 54 on one side to the corner 56 on the third side, for example. The zipper 40 may be attached to the upper portion 42 and the lower portion 44 of the side panels 36 by permanent conventional and/or non-conventional means, such as by sewing and/or RF welding and/or heat sealing and/or dielectric sealing and/or welding and/or ultrasonic sealing and/or heat sealing and/or bonding and/or utilizing adhesive and/or or weaving. As will be discussed in more detail below, the configuration of the zipper 40 facilitates installation of the encasement and also facilitates rotation of the mattress 58.

Figure 17B:
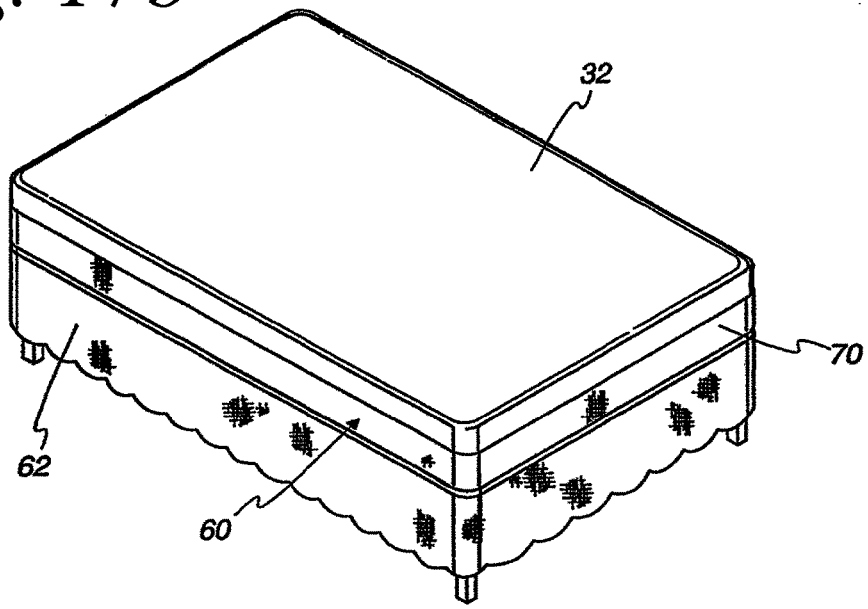
FIGS. 17*b*-17*d* illustrate the process of rotating a mattress using the cover illustrated in FIG. 17*a*.
Figure 17C:
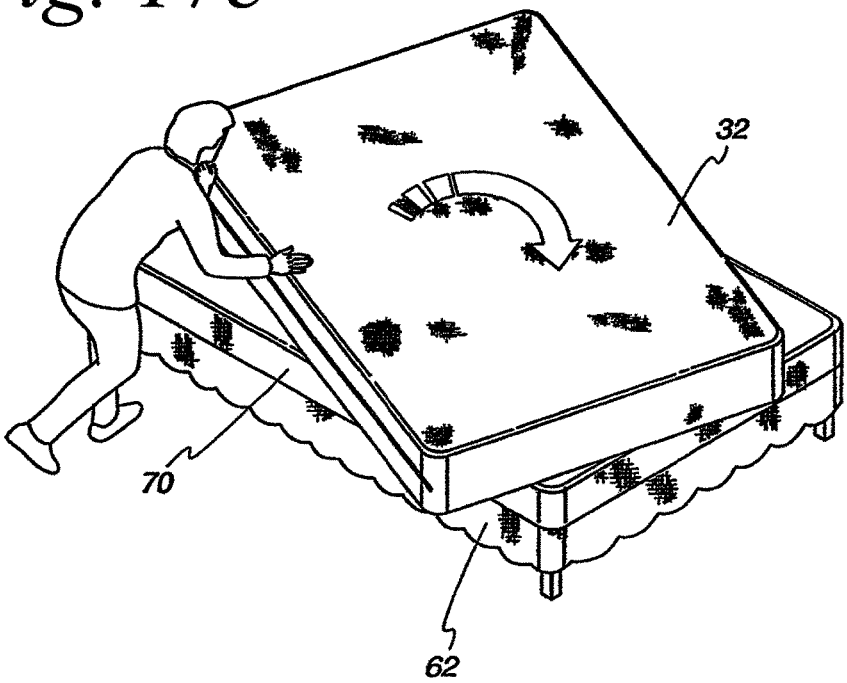
Figure 17D:
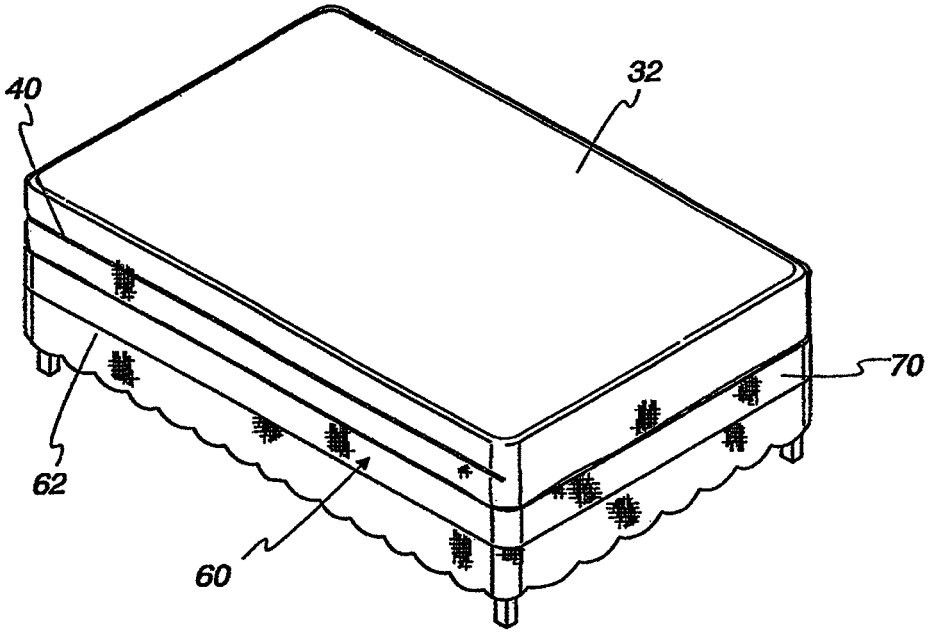
Figure 17E:
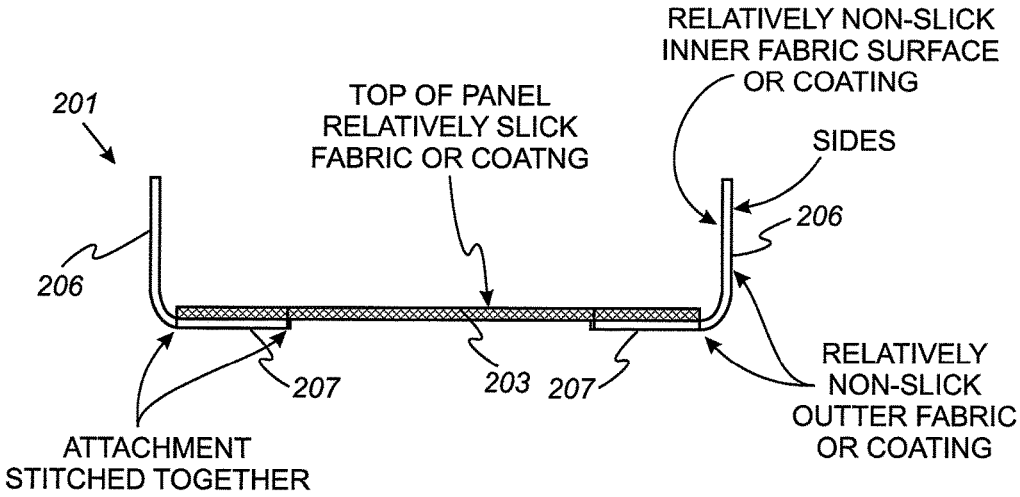
FIG. 17*e* is an alternate embodiment of the cover illustrated in FIG. 17*a* illustrating an embodiment in which the side panels overlap a portion of the rectangular panel of the cover, shown in a position in which it is attached to the underside of a mattress.
Figure 17F:
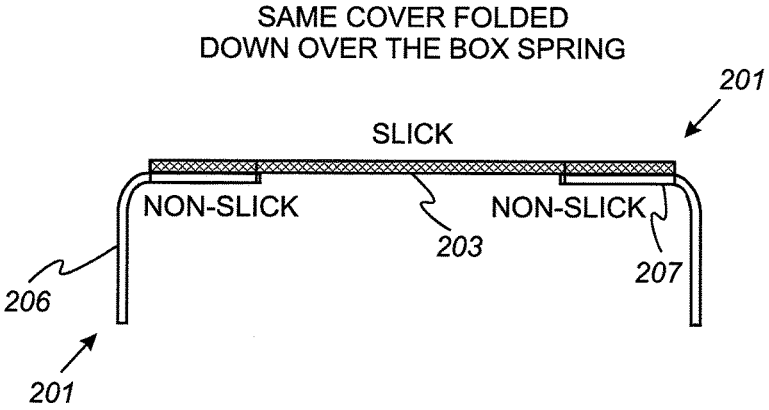
FIG. 17*f* is similar to FIG. 17*d* but shown in a position in which the cover is flipped down over a foundation.
Figure 17G:
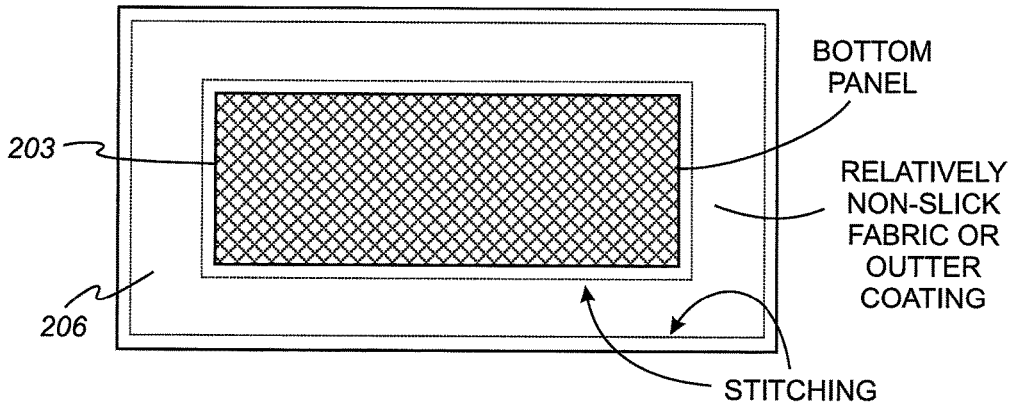
FIG. 17*g* is a bottom view of the embodiment illustrated in FIG. 17*e*.
Figure 17H:
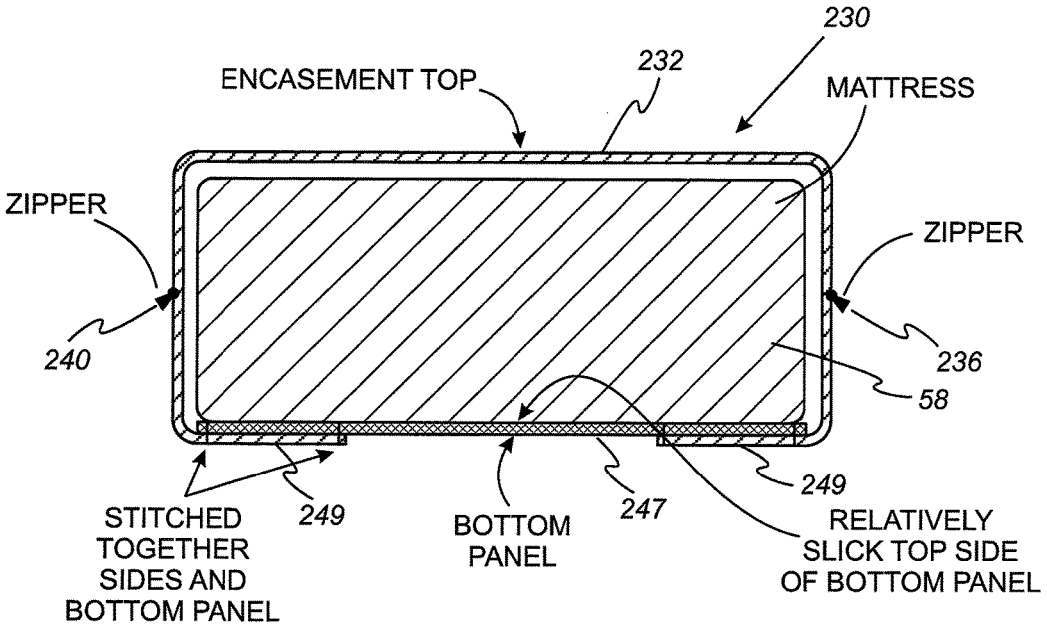
FIG. 17*h* is a cross-sectional view of an alternate embodiment of an encasement.
Figure 17I:
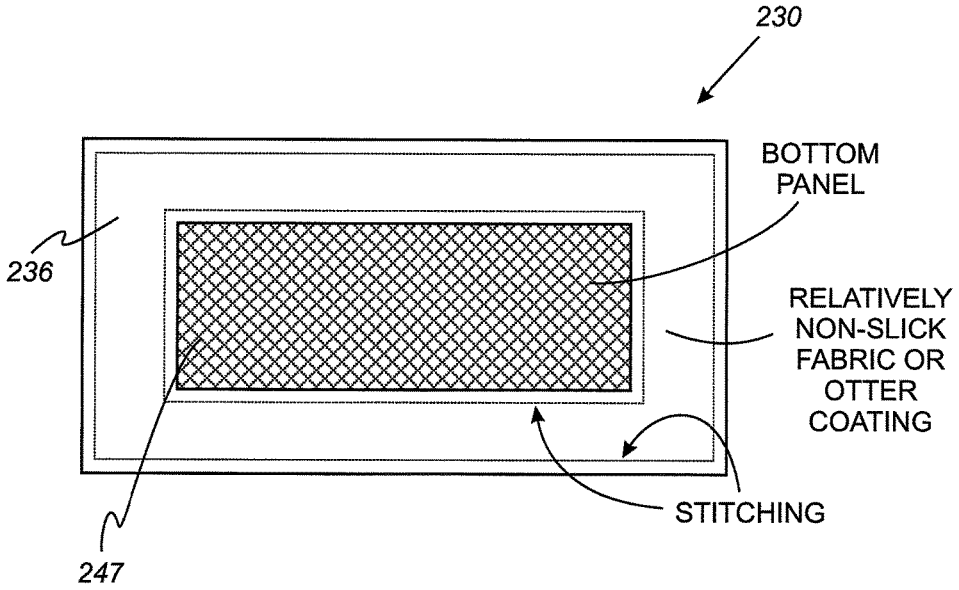
FIG. 17*i* is a bottom view of the cover illustrated in FIG. 17*h*.
Figure 18A:
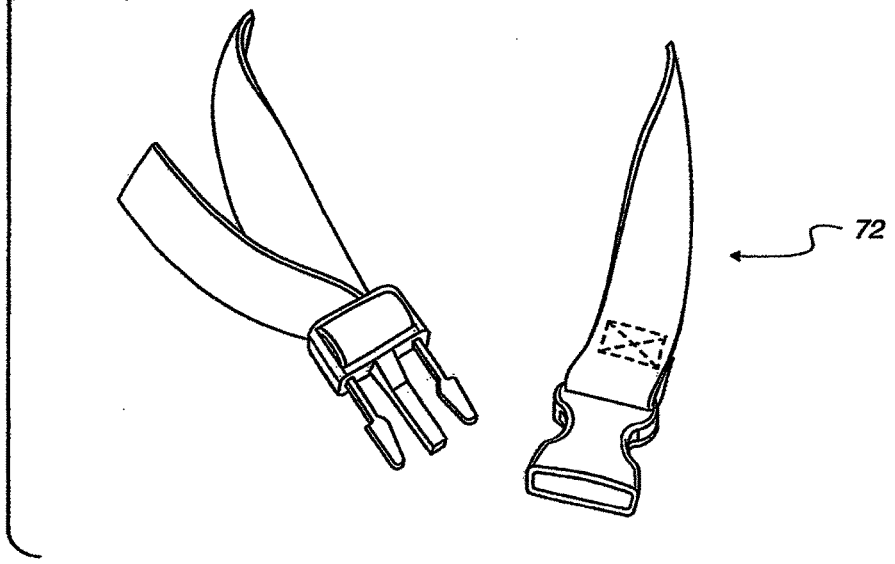
FIG. 18*a* is an isometric view of a first embodiment of an optional adjustable belt and buckle for use on an encasement in accordance with an alternate embodiment of the invention.
Figure 18B:
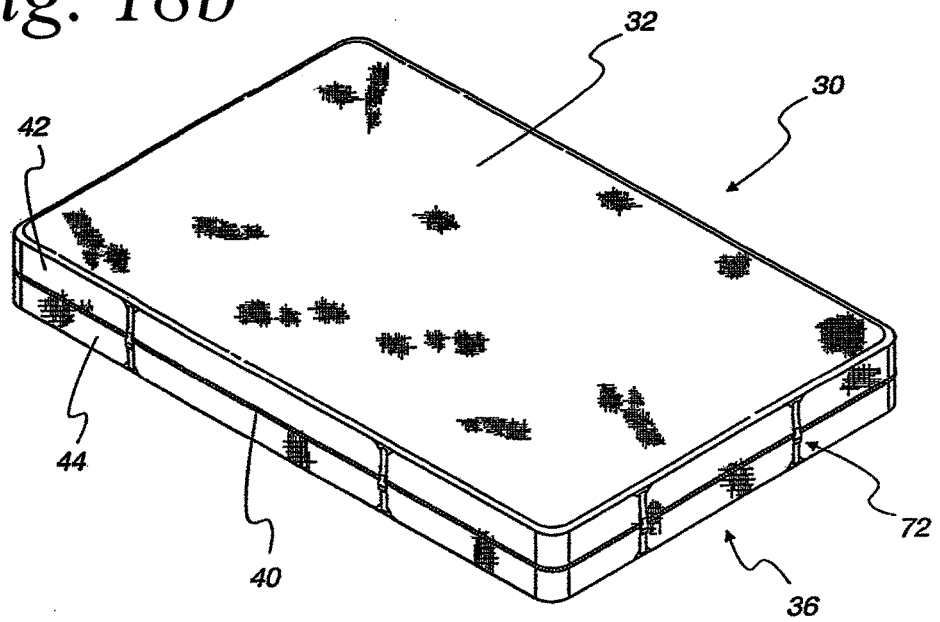
FIG. 18*b* is an isomeric view of the optional adjustable belt and buckle installed in various locations of an encasement installed on a mattress.
Figure 19A:
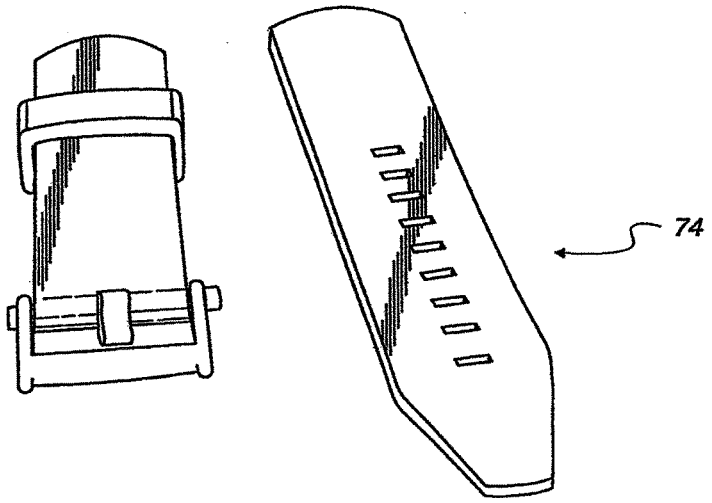
FIG. 19*a* is an isometric view of a second embodiment of an optional adjustable belt and buckle for use on an encasement in accordance with an alternate embodiment of the invention.
Figure 19B:
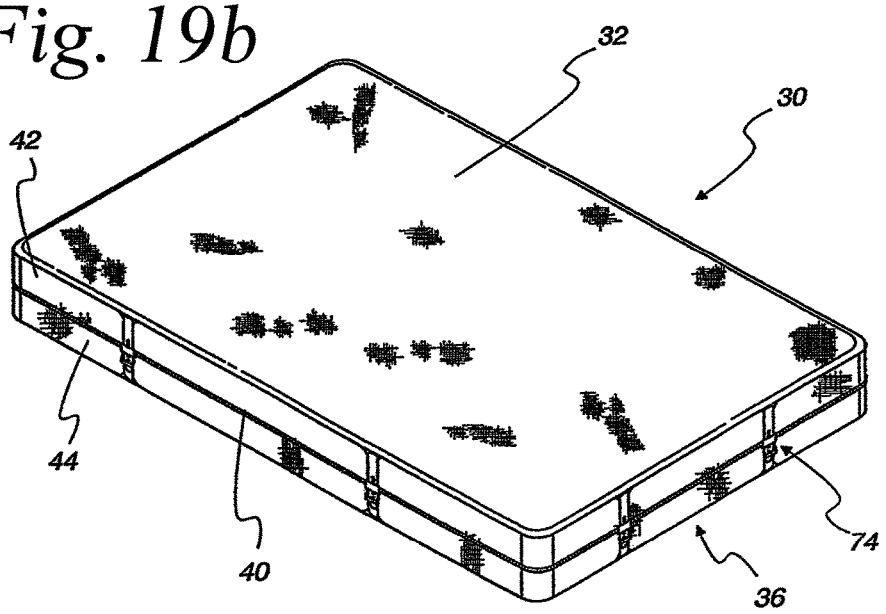
FIG. 19*b* is an isomeric view of the optional adjustable belt and buckle illustrated in FIG. 19*a* installed in various locations of an encasement installed on a mattress.
Figure 20A:
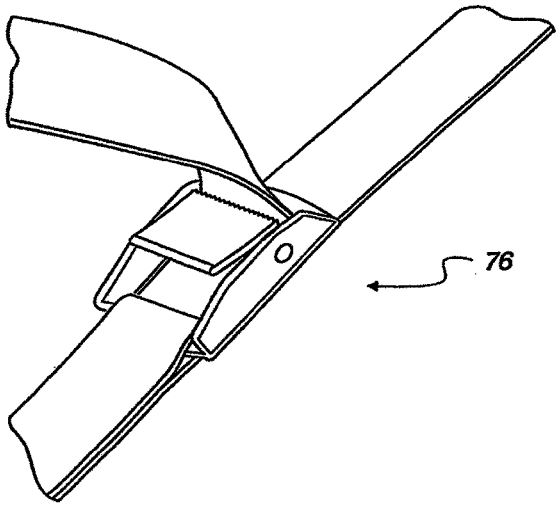
FIG. 20*a* is an isometric view of a third embodiment of an optional adjustable belt and buckle for use on an encasement in accordance with an alternate embodiment of the invention.
Figure 20B:
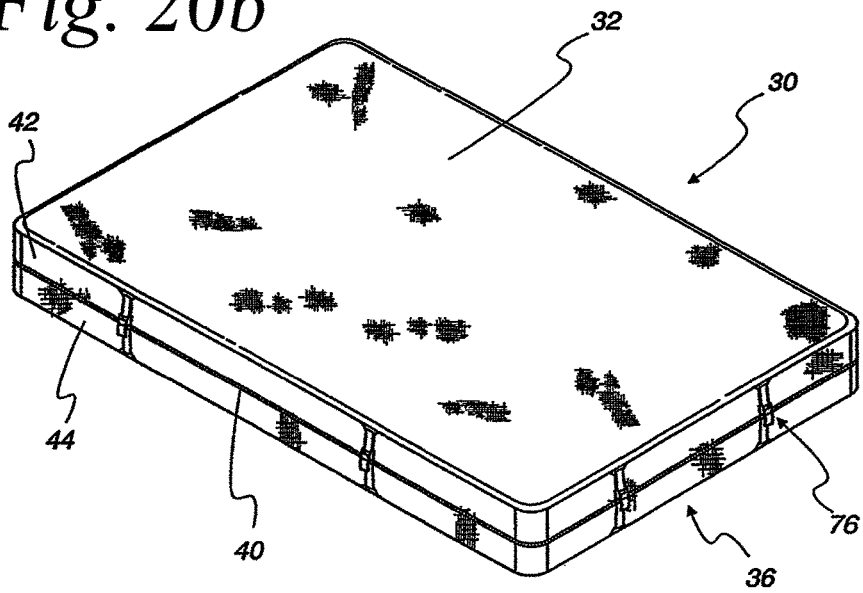
FIG. 20*b* is an isomeric view of the optional adjustable belt and buckle illustrated in FIG. 20*a* installed in various locations of an encasement installed on a mattress.
Figure 21A:
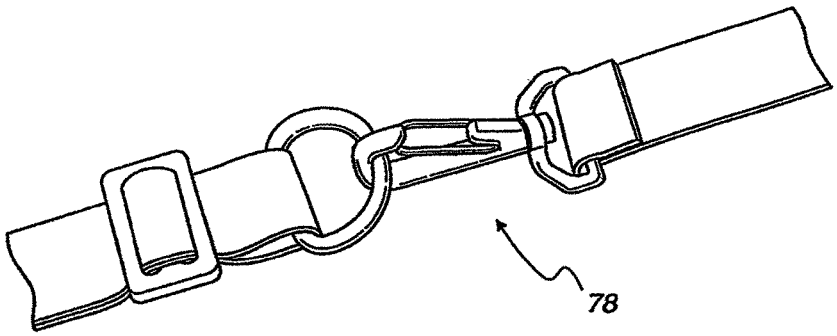
FIG. 21*a* is an isometric view of a fourth embodiment of an optional adjustable belt and buckle for use on an encasement in accordance with an alternate embodiment of the invention.
Figure 21B:
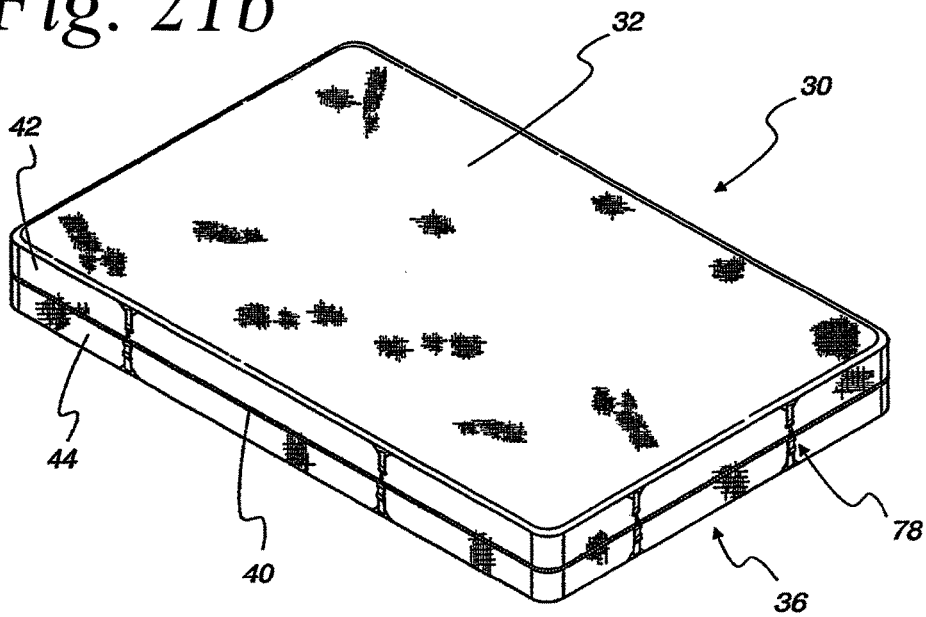
FIG. 21*b* is an isomeric view of the optional adjustable belt and buckle illustrated in FIG. 21*a* installed in various locations of an encasement installed on a mattress.
Figure 22A:
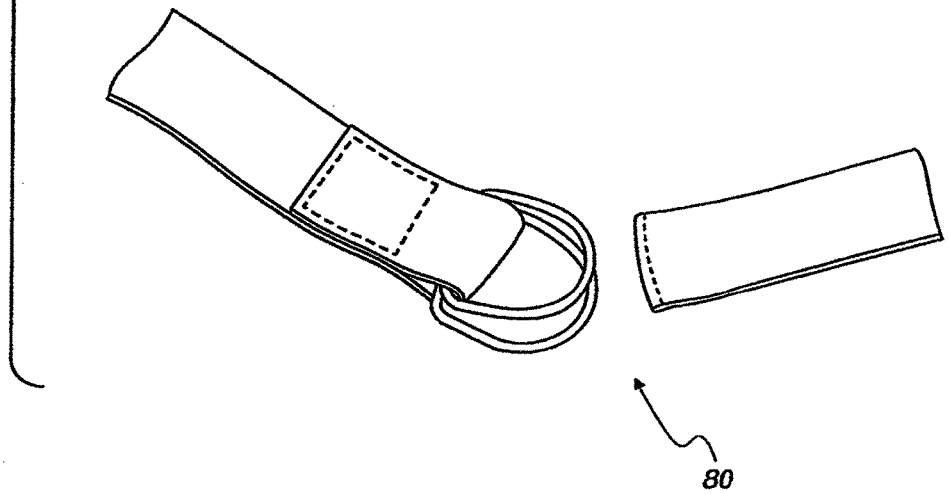
FIG. 22*a* is an isometric view of a fifth embodiment of an optional adjustable belt and buckle for use on an encasement in accordance with an alternate embodiment of the invention.
Figure 22B:
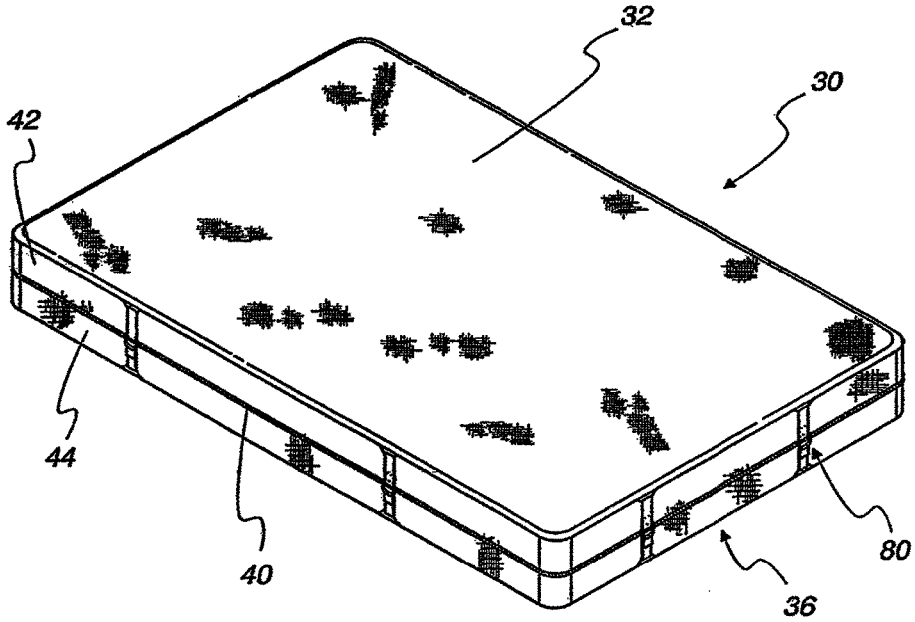
FIG. 22*b* is an isomeric view of the optional adjustable belt and buckle illustrated in FIG. 22*a* installed in various locations of an encasement installed on a mattress.
Figure 23A:
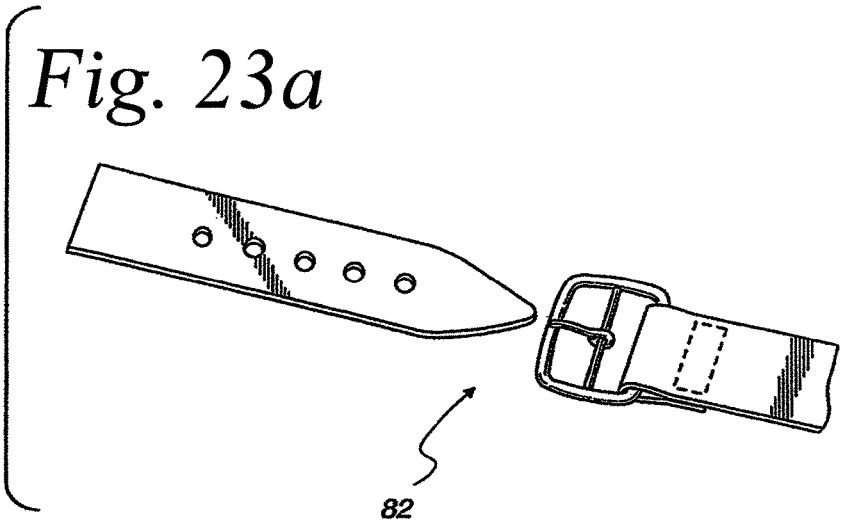
FIG. 23*a* is an isometric view of a sixth embodiment of an optional adjustable belt and buckle for use on an encasement in accordance with an alternate embodiment of the invention.
Figure 23B:
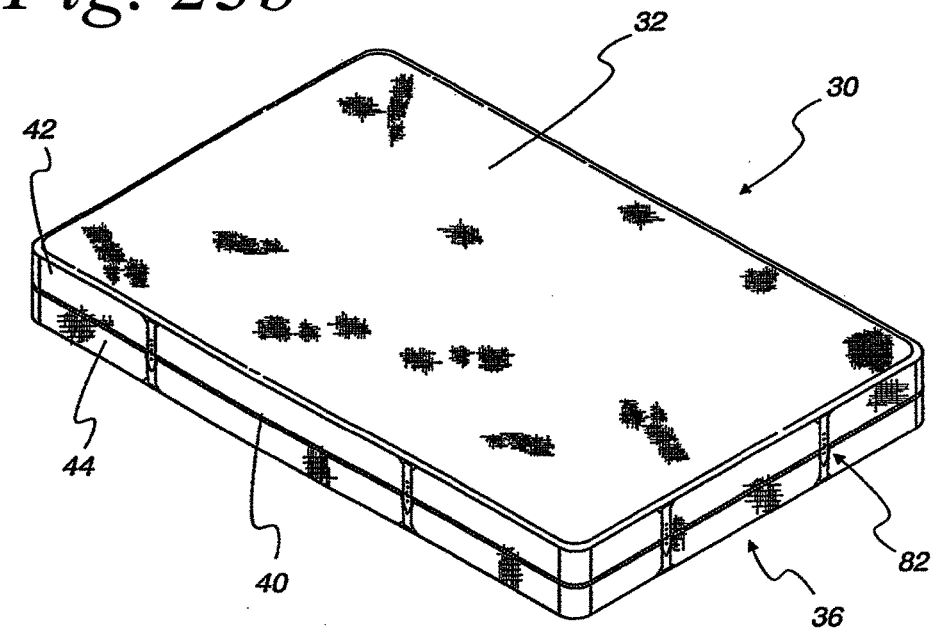
FIG. 23*b* is an isomeric view of the optional adjustable belt and buckle illustrated in FIG. 23*a* installed in various locations of an encasement installed on a mattress.

FIGS. 17*h* and 17*i* illustrate an alternate embodiment of the encasement 30, illustrated in FIG. 1. In this embodiment, the encasement is configured to reduce the need for coatings on the material. Referring to FIG. 17*h*, an encasement 230 is illustrated. The encasement 230 is similar to the encasement 30 (FIG. 1) and may be be used with a separate cover, such as the cover 66 (FIG. 17*a*) or the cover 201 (FIGS. 17*g*-17*i*).

This embodiment includes a top cover 232, side covers 236 and a zipper 240, as well as a bottom panel 247. Except for the bottom panel 247, the encasement 230 is similar to the encasement 30, illustrated in FIG. 1. In this embodiment, the bottom panel 247 may be formed from a homogeneous material with no coatings in which both sides are slick. Alternatively, the rectangular panel 203 can include a slick or non-slick coating on one side or be made from a slick or non-slick material. As shown best in FIG. 17*h*, the side panels 236 are formed to be extended so that the extensions 249 can be folded down over to overlap the underside of the bottom cover 247 and attached thereto by stitching or other permanent conventional means. In this embodiment, the side panels 236 are formed from a non-slick material, and may reduce the need to provide any coatings on the bottom panel 247. Similarly, the side panels 236 may be made from another homogeneous material with no coatings in which both sides are non-slick. Alternatively, the side panels 236 can include non-slick coatings and may be made from slick or non-slick material.

FIG. 2 illustrates a mattress 58 covered by an encasement 30, supported by a foundation 60. As shown, the zipper 40 is partially unzipped. FIG. 2*a* illustrates the zipper extending to the corner 56 of the encasement 30, for example.

Figure 3:
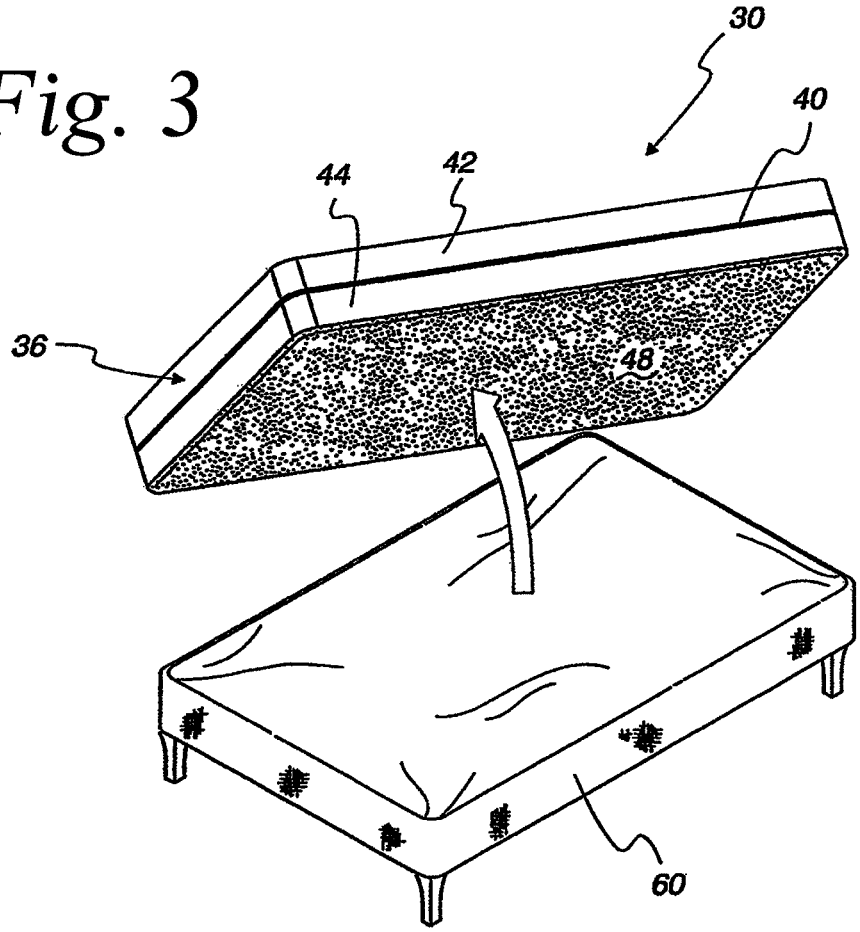
FIG. 3 is an isometric view of a mattress covered with an encasement, shown removed from the foundation.
Figure 4:
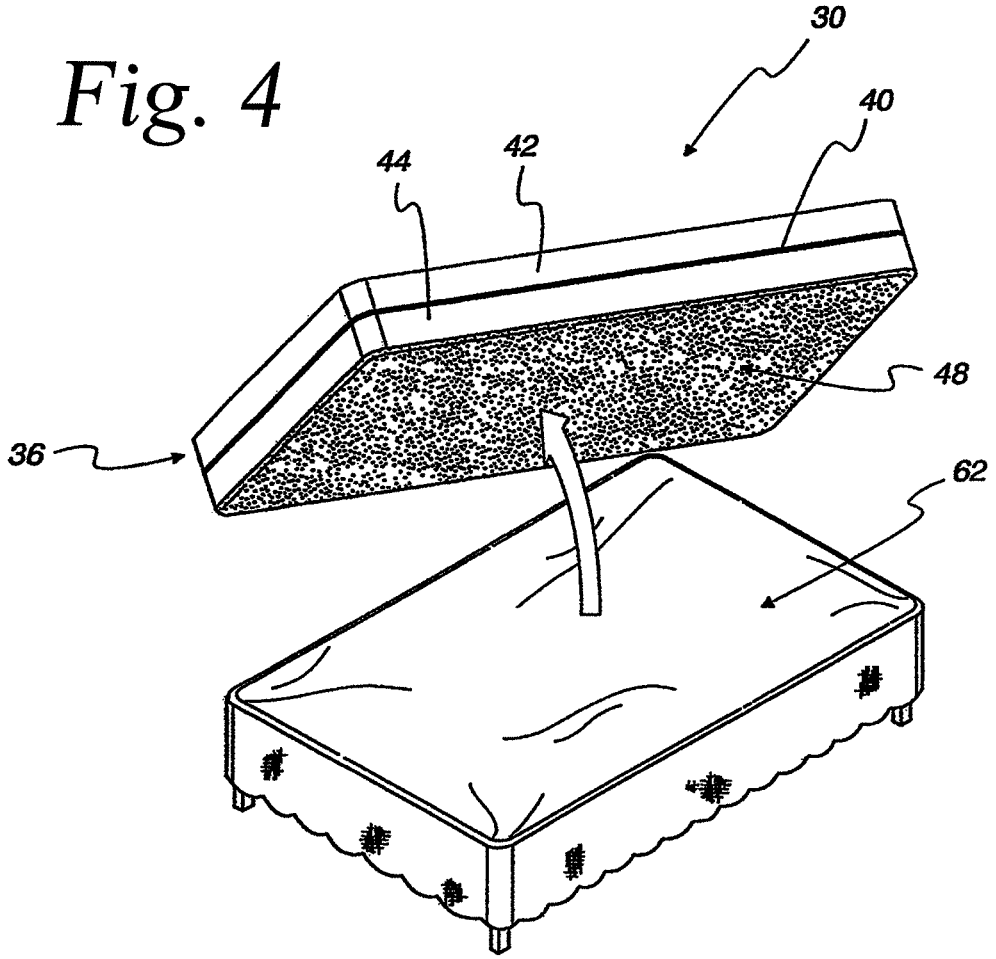
FIG. 4 is similar to FIG. 3 except illustrating a bed skirt covering the foundation.

FIGS. 3 and 4 illustrate a mattress covered by an encasement 30, shown removed from a foundation 60. FIG. 3 illustrates an application in which does not include a bed skirt 62. FIG. 4 is similar to FIG. 3 but illustrates a bed skirt 62 covering the foundation 60. As will be discussed in detail below, the mattress management features provided by the encasement 30 in accordance with the present invention work equally well whether or not a bed skirt 62 is provided on the foundation 60.

In accordance with one aspect of the invention, FIGS. 5-12 illustrate the installation of a bed skirt over a foundation and installation of an encasement 30 over a mattress 58 supported by a foundation 60. Unlike known encasements, installation and removal of the encasement 30 does not require extensive lifting of the mattress 58, as discussed above. In addition to facilitating installation and removal of the encasement over a mattress 58, the encasement 30 provides various mattress management features, such as:

- Holding a bed skirt 62 in place while the encasement 30 is being installed on the mattress 58.
- Holding a bed skirt 62 in place while the mattress 58 is being rotated.
- Enabling the mattress 58 to be more easily rotated without lifting the mattress 58.
- Enabling the mattress 58 to be easily installed or removed to change and/or launder the bed skirt or the encasement.

Figure 5:
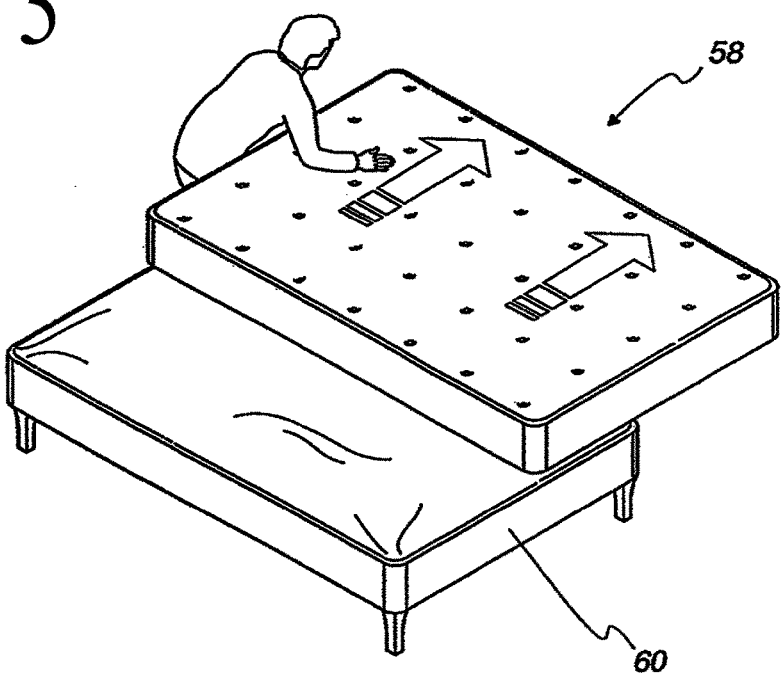
FIG. 5 is an isometric view of a mattress and a foundation illustrating one person removing the mattress from the foundation covered with a bed skirt, shown with the mattress partially removed.
Figure 6:
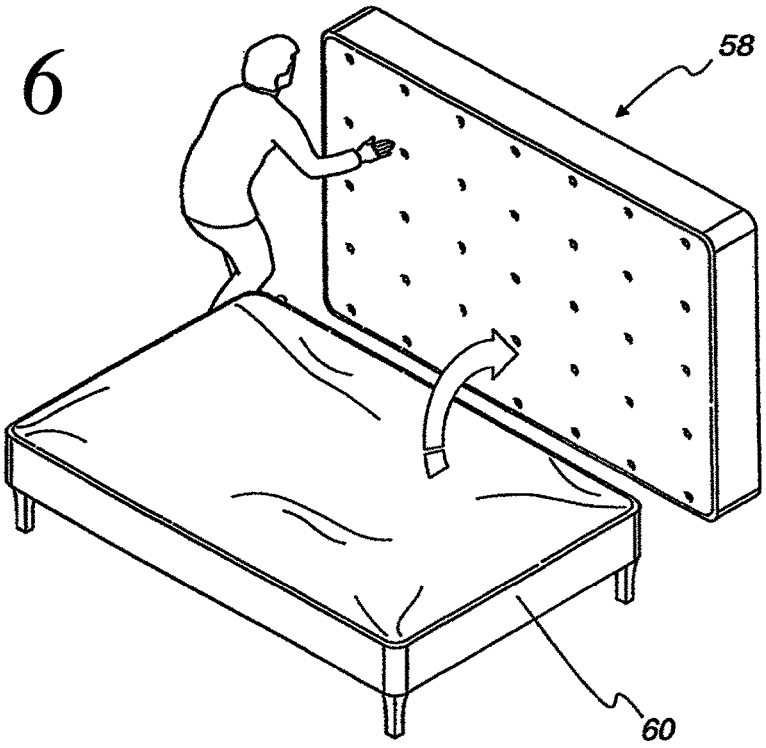
FIG. 6 is similar to FIG. 5, but shown with the mattress totally removed.
Figure 7:
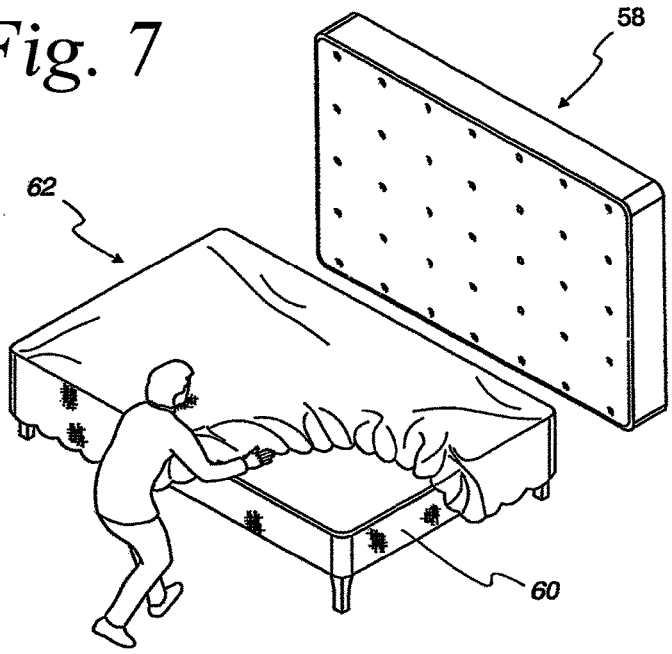
FIG. 7 is similar to FIG. 6, but illustrating a person installing a bed skirt on a foundation.
Figure 8:
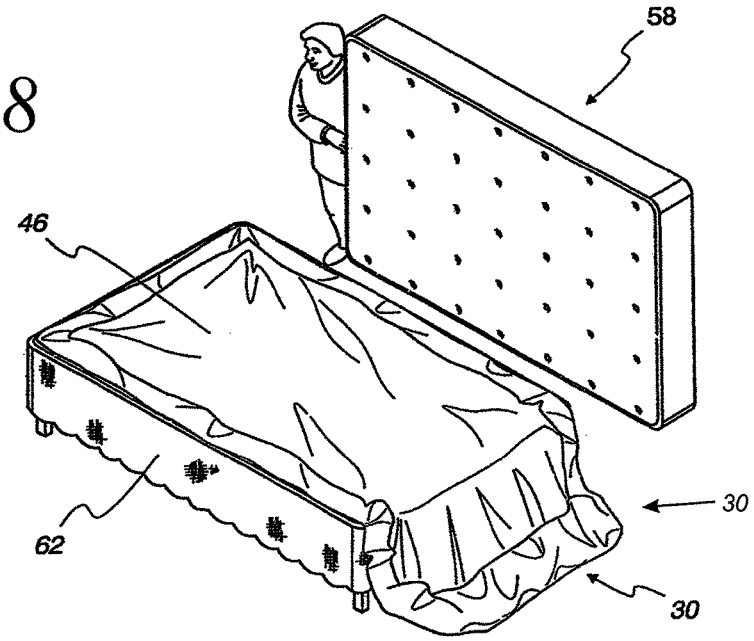
FIG. 8 illustrates the bed skirt installed and an encasement in accordance with the present invention laying on top of the foundation, shown fully unzipped with a bottom panel in contact with the foundation and the top panel on the floor at one end of the bed and a lower portion of the unzipped side panel resting on an inner surface of the bottom panel.

Turning first to FIG. 5, the mattress 58 is slid off the foundation 60 and stood on one end, as illustrated in FIG. 6. If desired, a bed skirt 62 may be installed or removed over the foundation 60, as illustrated in FIG. 7. An important aspect of the encasement 30 is that it will hold the optional bed skirt 62 in place while the mattress 58 is being installed or removed or rotated on top of the foundation 60, with or without a bed skirt, and also while the mattress 58 encased in an encasement 30 is rotated, as discussed below. The non-slick exterior surface 48 (FIG. 1) on the bottom panel 34 of the encasement 30 secures the bed skirt 62 in place. More particularly, as illustrated in FIG. 8, the encasement 30 is completely unzipped and placed on top of the foundation 60 or bed skirt 62, as shown. The encasement 30 is placed on top of the bed skirt 62 with the non-slick exterior 48 of the bottom panel 34 in contact with the bed skirt 62. The top panel 32 of the encasement 30 is draped on the floor on one end of the mattress. As shown in FIG. 8, the bottom portions 42 of the side panels 36 are resting on top of the slick interior surface 46 of the bottom panel 34. In applications without a bed skirt 62, the non-slick outer surface 48 of the bottom panel 34 will be in contact with the foundation 60.

Figure 9:
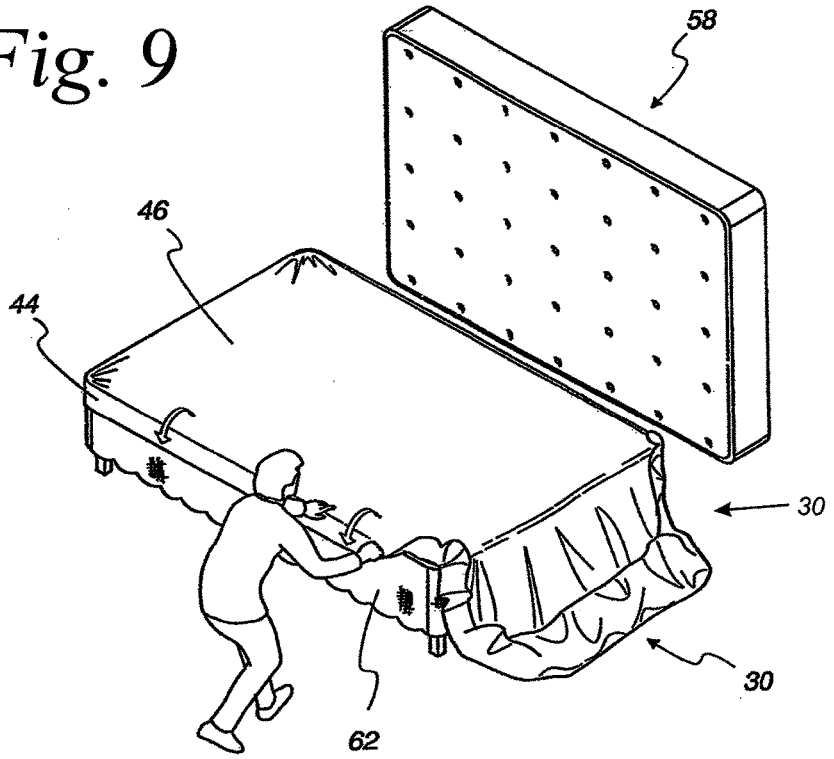
FIG. 9 is similar to FIG. 8 illustrating a person unfolding a portion of the side panel that was resting on the inner surface of the bottom panel so that side panel portions of the encasement are folded down over the sides of the bed skirt.
Figure 10:
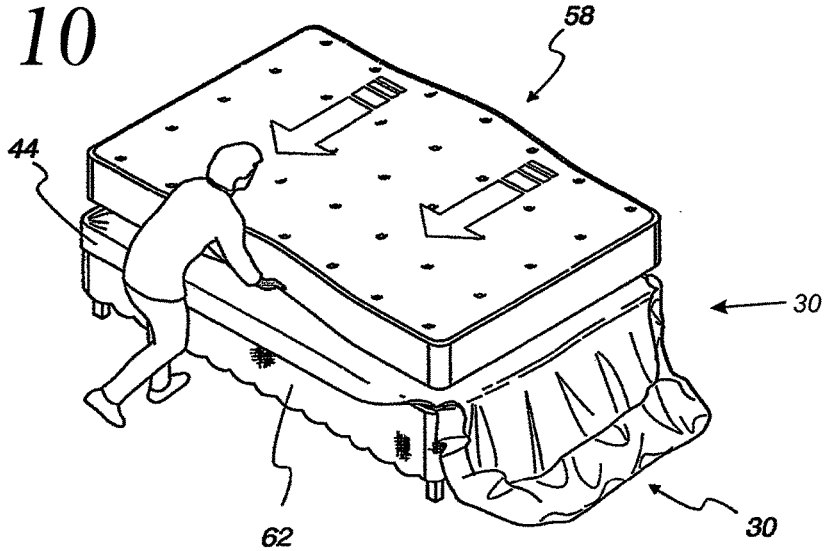
FIG. 10 illustrates a person sliding the mattress on top of the inner surface of the bottom panel of the encasement.

As shown in FIG. 9, the bottom portions 44 of the side panels 36 are folded down to be in contact with the bed skirt 62 or alternatively, the foundation 60. Once the bottom portions 42 of the sides 36 are completely folded down, the mattress 58 is slid in place over the interior surface 46 of the bottom panel 34 of the encasement 30, as illustrated in FIG. 10. The interior surface 46 of the bottom panel 34 is formed with a slick surface to facilitate sliding the mattress 58 into place. The non-slick exterior surface 48 of the bottom panel 34 holds the encasement 30 in place over the bed skirt 62 or foundation 60 while the mattress 58 is being slid in place.

Figure 11:
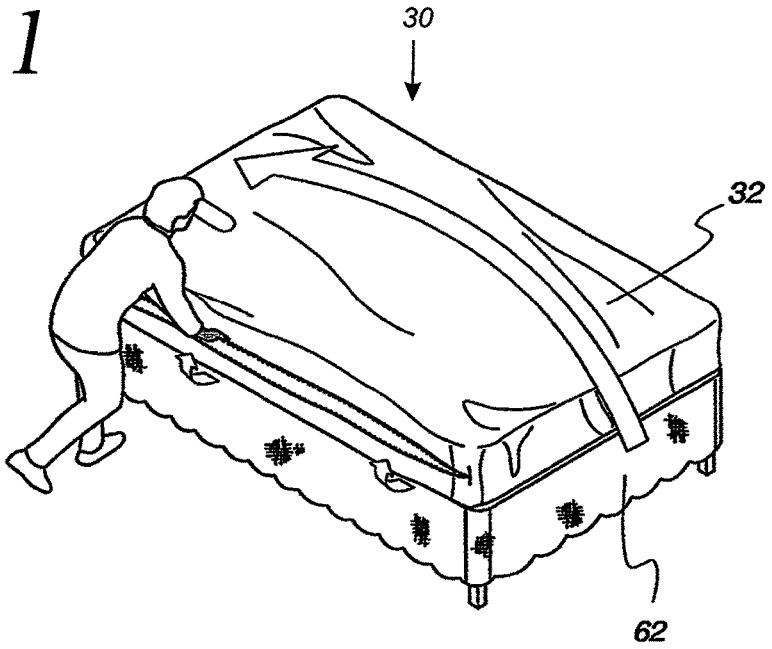
FIG. 11 illustrates a top panel of the encasement being placed over the top of the mattress.
Figure 12:
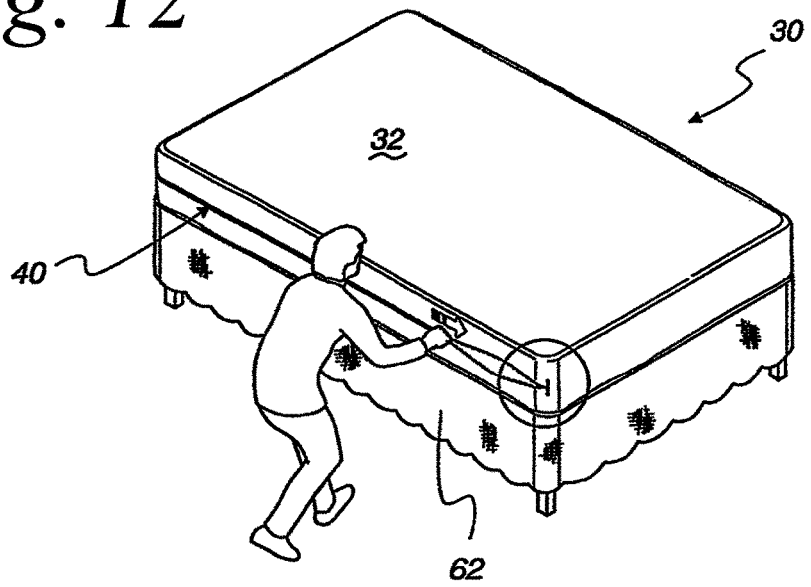
FIG. 12 illustrates an upper side panel portion and a lower side panel portion being zipped together.

Once the mattress 58 is in place, the top panel 32 of the encasement 30 is placed over the top of the mattress 58, as shown in FIG. 11. The encasement 30 is then zipped up by way of the zipper 40, as shown in FIG. 12.

FIGS. 13-17 illustrate a novel method of mattress management which relates to rotating a mattress 58 with an encasement 30. As mentioned above, mattresses can be relatively heavy and difficult to rotate. Moreover, an encasement 30 covers up the mattress handles making it even more difficult to rotate the mattress. The novel method for rotating a mattress with an encasement overcomes these problems.

Figure 13:
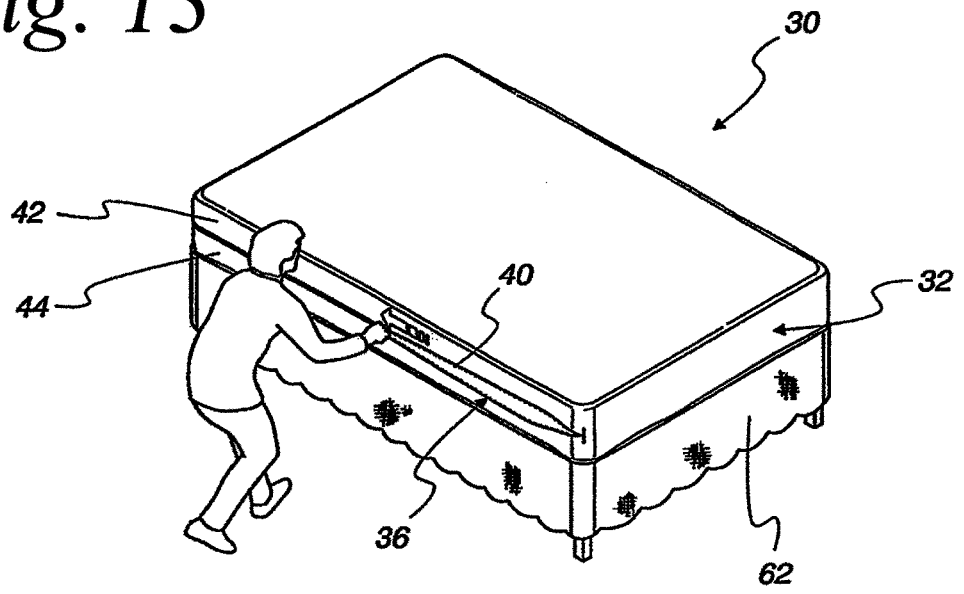
FIG. 13 illustrates the upper and lower side panel portions of an encasement being unzipped in preparation for rotation of the mattress.
Figure 14:
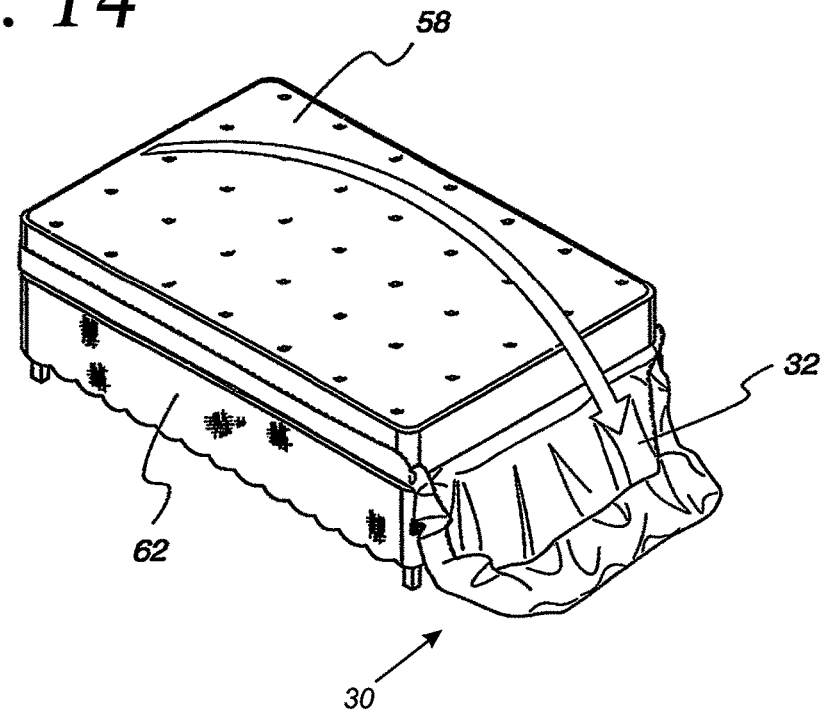
FIG. 14 illustrates the top panel of an encasement removed from the mattress and draped on the floor at one end of the mattress.

Initially, as shown in FIG. 13, the zipper 40 is unzipped around all three side panels 36. Once the zipper 40 is unzipped, the top panel 32 is draped on the floor on one end of the mattress, as shown in FIG. 14. Next, as illustrated in FIG. 15, the lower portions 44 of the side panels 36 are folded down to be in contact with the bed skirt 62 or alternatively the foundation 60 in applications where a bed skirt 62 is not used. Once the lower portions 44 of the side panels 36 are all folded down, the mattress 58 can be rotated in a horizontal plane, for example, 180 degrees, as generally illustrated in FIG. 16. This is done to even out mattress wear and body impressions or indentations. In this application, the mattress handles are exposed to facilitate rotation. The slick interior surface 46 of the bottom panel 34 facilitates rotation while the non-slick exterior surface 48 of the bottom panel 34 holds the bottom panel 34 in place against the bed skirt 62 or alternatively, the foundation 60.

Once the mattress 58 is rotated in place, the top cover 32 is placed over the mattress 58, as shown in FIG. 11. The encasement 30 is then zipped up by way of the zipper 40, as shown in FIG. 17.

In an alternate embodiment, various mattress management features can be accomplished can also be accomplished with a modular component; namely a cover 66, for example, as illustrated in FIG. 17*a*-17*d*. The cover 66 may include a rectangular panel 68 and four side panels, generally identified with the reference numeral 70. The cover 66 may be configured with the same length and width dimensions as the encasement 30. One side 67 of the cover 66 is provided with a slick surface and an opposing side 69 of the cover 66 is provided with a non-slick surface. The side panels 70 may be formed from a stretchable material to enable the cover 66 to be held in place over a foundation 60 and optionally a bed skirt 62 or optionally a mattress 58 with an encasement. Alternatively, the cover 66 may be formed without side panels. A suitable cover is described in detail in US Patent Application Publication No. US 2013/0019411 A1, hereby incorporated by reference.

An alternate embodiment of the cover 66 is illustrated in FIGS. 17*e*, 17*f* and 17*g* and identified with the reference numeral 201. In this embodiment, the cover 201 includes a rectangular panel 203 and four (4) side panels 206. As shown best in FIG. 17*e*, the side panels 206 are extended and are folded over so as to overlap the underside of the rectangular panel 203. In this embodiment, the rectangular panel 203 may be made from a homogeneous material with no coatings in which both sides are slick. Alternatively, the rectangular panel 203 can include a slick or non-slick coating on one side or be made from a slick or non-slick material. Similarly, the side panels 206 may be made from another homogeneous material with no coatings in which both sides are non-slick. Alternatively, the side panels 206 can include or non-slick coatings and may be made from slick or non-slick material. The overlapping side panels 206 are fastened to the underside of the rectangular panel 203 by stitching or other permanent conventional means. By eliminating fabric coatings, the cover 201 can be made much less expensively than the cover 66. Alternatively, the cover 66 (FIG. 17*a*) as well as the cover 201 (FIGS. 17*e*-17*g*) may be formed from a single bottom panel with no side panels and attached to the encasement 30 (FIG. 1) by way of conventional or non-conventional fasteners, or not attached. The covers 66 and 201 may be attached by way of conventional means, such as Velcro, hook and loop, straps and/or buckle, buttons, snaps, zippers or other conventional fasteners as illustrated in FIGS. 18*a*, 19*a*, 20*a*, 21*a*, 22*a*, 23*a*, 24, and 25.

As used herein, the terms "attach" or "attached" means the side panels of the cover 66 (FIG. 17*a*,), 201 (FIGS. 17*e*-17*g*) are juxtaposed over the sides of the encasement 30 or foundation 60 or bed skirt 62. Alternatively, "attach" or "attached" means attached by way of conventional fasteners, for example, as described herein.

In this application, in a normal mode of operation, as illustrated in FIG. 17*b*, the cover 66 is attached over the encasement 30 and over the zipper 40 so that the non-slick surface 69 of the cover 66 is in contact with the bed skirt 62 or foundation 60 and the slick surface 67 of the cover 66 is in contact with the encasement 30. In this mode of operation, the side panels 70 of the cover 66 may be configured to hide the zipper 40 on the encasement 30. Since the non-slick surface 69 of the cover 66 is in contact with the foundation 60 or bed skirt 62, the mattress 58 will not rotate.

In order to rotate the mattress 58 without removing the encasement 30, the cover 66 or the alternate cover consisting of a bottom panel with no side panels is detached, if attached, from the mattress 58 and encasement 30 and attached or juxtaposed over the bed skirt 66 or foundation 60 defining a rotate mode of operation. In this mode of operation, the non-slick surface 69 of the cover 66 will be in contact with the foundation 60 or bed skirt 62. The slick surface 67 of the cover 66 will be in contact with the exterior surface 48 of the bottom panel 34 of the encasement 30, as shown in FIGS. 17*c* and 17*d*. Even though the slick surface 67 of the cover 66 is in contact with the exterior surface 48 of the bottom panel 34, the slick surface 67 of the cover 66 will allow the mattress 58 to rotate while the non-slick surface 69 of the cover 66 holds the bed skirt 62 in place over the foundation 60. The mattress 58 can then be rotated 180 degrees, for example, in a horizontal plane, as illustrated in FIG. 16, without removing the encasement 30 from the mattress 58 while holding the bed skirt 62 in place. After the mattress 58 is rotated, the cover 66 may be re-attached to the encasement 30, which is over the underside of the mattress.

In embodiments, as illustrated in FIGS. 17*e*-17*g*, the side panel extensions 207 (FIG. 37*a*) may be formed from a slick material or material with a slick coating to facilitate tucking the sheets between the mattress 58 and a foundation 60 or platform. Alternatively, the side panel extensions 207 may be formed from a non-slick material or coated with a non-slick coating one or both sides. As mentioned above, although the length and width dimensions of mattresses are standard, the depth dimensions vary considerably. In order to reduce the number of encasements that need to be manufactured, encasements are known to be manufactured to accommodate several depths for each mattress standard length and width size. A few commonly available encasements have depth ranges as set forth below.

6-9" depth
7-12" depth
9-12" depth
11-18" depth

Unfortunately, depending on the actual mattress depth, such encasements do not provide a snug fit. For example, a 6 inch depth mattress will not fit very snug in an encasement made to fit mattresses 6 to 9 inches thick.

In order to provide a snug fit for encasements relative to the depth of mattresses and foundations, exemplary optional adjustable straps 72-82 are illustrated in FIGS. 18*a*-23*a*, respectively. Other adjustable straps are suitable. These adjustable straps are connected between the upper portion 42 and the lower portion 44 of the side panels 36, as shown in FIGS. 18*b*-23*b*. The straps 72-82 may also be provided on the fixed side or un-zippered side panel 38 (FIG. 1) to allow the encasement 30 to be snugged up against the mattress. The side panels 36 and 38 may be pleated to allow the excess portions to be neatly folded. The straps 72-82 may also be used to attach and snug the cover 66 (FIG. 17*a*) to the encasement 30.

The straps illustrated in FIGS. 18*a*-23*a* may be incorporated with conventional and non-conventional encasements or alternatively in combination with the novel encasement 30 illustrated in FIG. 1 and described herein. All of such embodiments are contemplated by the present invention.

FIG. 24 illustrates optional horizontal straps, generally identified with the reference numeral 86. These horizontal straps 86 can be used to snug the encasement 30 with respect to the mattress 58 in a horizontal direction. The straps 86 may be disposed below the zipper 40. As shown, Velcro® cinch type straps may be provided. Other means are contemplated for tightening the encasement 30 relative to the mattress 58. For example, the straps 72-82, discussed above, as well as buttonholes and buttons, or other conventional means may be used. It is also contemplated that combinations of vertical and horizontal straps can be used.

Figure 25:
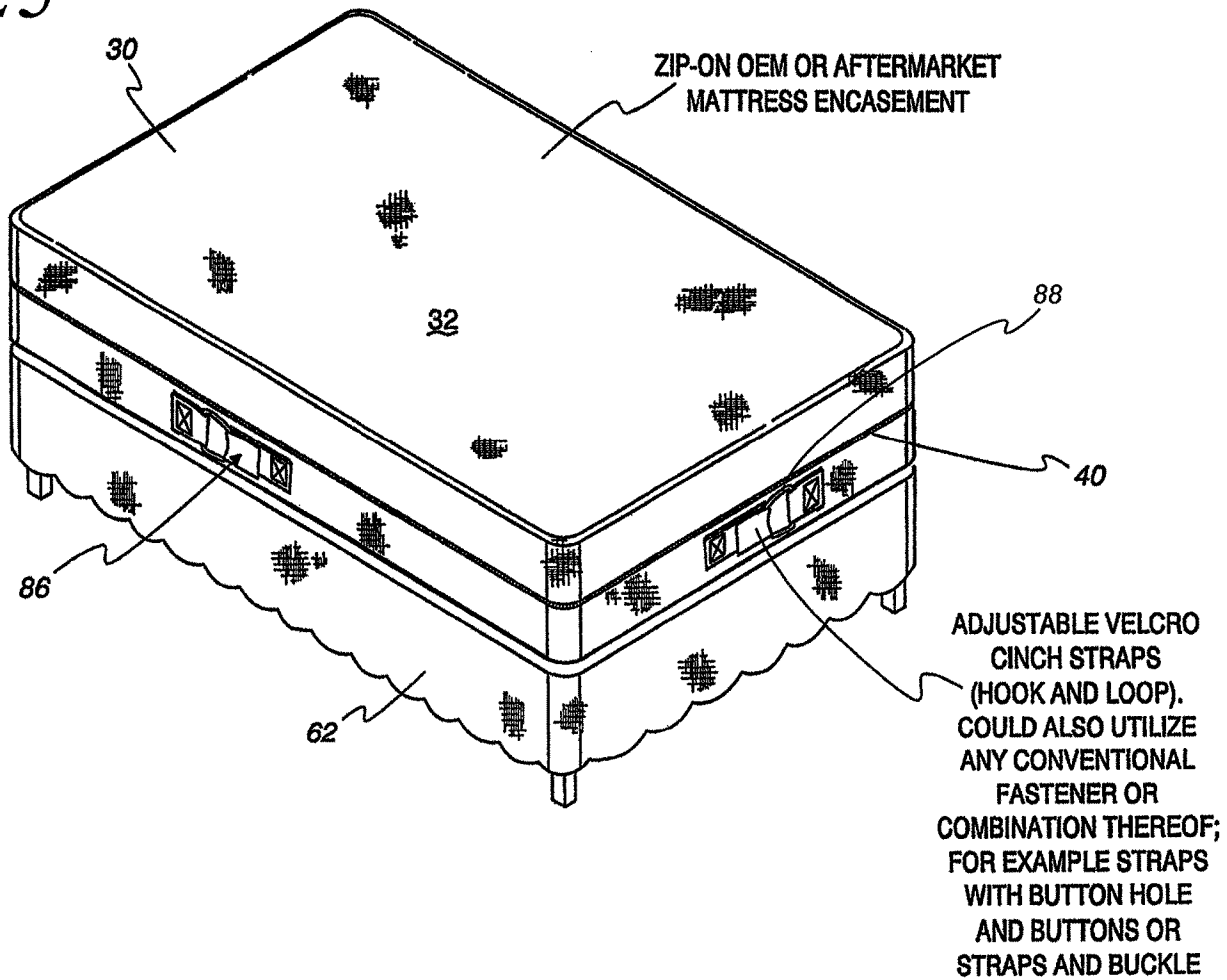
FIG. 25 is similar to FIG. 24 and illustrates an alternative embodiment of the horizontal straps illustrated in FIG. 24.

FIG. 25 illustrates and alternate embodiment of the horizontal adjustment devices 86 in FIG. 24. In this embodiment, a ring 88 is provided to enable the strap 86 to be looped there through and tightened. Both embodiments, illustrated in FIGS. 24 and 25 may be used as horizontal adjustment devices, as shown, and/or vertical adjustment devices.

In accordance with another aspect of the invention, the encasement 30 (FIG. 1) can be configured so that a bottom portion of the encasement 30 is standard for all encasement depths. In this embodiment, a top portion of the encasement 30 is formed to accommodate various encasement depths. In such an embodiment, the encasement 30 is zippered on all four sides. The top portion includes the top panel 32 and the upper portions 42 of all four side panels 36. The bottom portion includes the bottom panel 34 and the lower portions 44 of all four side panels 36. In this embodiment, the transverse length (normal to the longitudinal length) of the upper portion 42 and the lower portion 44 of the side panels are not equal. The transverse length of the lower portion 44 of the side panel 36 may be set to a standard value. In order to accommodate encasements of different depths, the transverse length of the upper portions 42 of the side panels may vary as function of the overall depth of the encasement.

For example, a bottom portion of the encasement with a transverse length of 4 inches may be used with 8 inch and 10 inch encasements. For an mattress encasement with an 8 inch depth, an upper portion 42 with a 4 inch transverse length is used along with the 4 inch lower portion 44. For a 10-inch encasement, an upper portion 42 with a 6-inch transverse length is used along with the 4 in lower portion 44. Thus, the bottom portion of the encasement 30 may be standardized for different encasement depths.

Obviously, many modifications and variations of the present invention are possible in light of the above teachings. For example, materials for the covers and slick surfaces other than those mentioned above can be which have similar co-efficient of friction characteristics. Thus, it is to be understood that, within the scope of the appended claims, the invention may be practiced otherwise than as specifically described above.

I claim:

1. An encasement for a mattress or foundation comprising:

a top panel defining an exterior surface and an interior surface;

a bottom panel having an interior surface and a non-slick exterior surface, said interior surface of said bottom panel formed at least in part with a slick surface relative to said non-slick exterior surface of said bottom panel to facilitate movement of said mattress with respect to said bottom panel, said non-slick surface being substantially coextensive with said exterior surface of said bottom panel;

a plurality of side panels forming an encasement with said top panel and said bottom panel, said plurality of side panels including at least one separable side panel, said at least one separable side panel defining a separable upper portion and a separable lower portion, said separable upper portion attached to said top panel and said separable lower portion connected to said bottom panel; and a zipper for attaching said separable upper portion to said separable lower portion of said one or more separable side panels in a normal mode of operation or alternatively at least partially detaching said separable upper side panel portion from said separable lower side panel portion of said one or more separable side panels in an alternate mode of operation to enable at least a portion of said top panel to be at least partially removed from said mattress or foundation to enable movement of said mattress or foundation with respect to said slick surface on said interior surface of said bottom panel.

2. The encasement as recited in claim 1, wherein said top panel, bottom panel and at least one of said plurality of side panels are made from a launderable material.

3. The encasement as recited in claim 1, wherein said top panel, bottom panel and at least one of said side panels are made from encasement material or a material commonly used for mattress protectors, as well as conventional bedding material.

4. The encasement as recited in claim 1, wherein said exterior surface of said top panel is made from a launderable material and said interior surface is formed from a waterproof material.

5. The encasement as recited in claim 1, wherein said separable upper portion and said separable lower portion of said at least one separable side panel are formed as continuous strips.

6. An encasement for a mattress or foundation comprising:

a top panel defining an exterior surface and an interior surface;

a bottom panel having an interior surface and a non-slick exterior surface, said interior surface of said bottom panel formed at least in part with a slick surface relative to said non-slick exterior surface of said bottom panel to facilitate movement of said mattress with respect to said bottom panel, said non-slick surface being substantially coextensive with said exterior surface of said bottom panel;

four side panels forming an encasement with said top panel and said bottom panel, said four side panels formed as four separable side panels, each separable side panel defining a separable upper portion and a separable lower portion, said separable upper portions connected to said top panel and said separable lower portions connected to said bottom panel; and a zipper for attaching and detaching said separable upper portions relative to said separable lower portions of all of said four side panels to enable the top and separable upper portions to be removed from the encasement on all four sides.

* * * * *